US005388930A

United States Patent [19]

McNease

[11] Patent Number: 5,388,930

[45] Date of Patent: Feb. 14, 1995

[54] METHOD AND APPARATUS FOR TRANSPORTING AND USING A DRILLING APPARATUS OR A CRANE APPARATUS FROM A SINGLE MOVABLE VESSEL

[75] Inventor: Daniel F. McNease, Tomball, Tex.

[73] Assignee: Rowan Companies, Inc., Houston, Tex.

[21] Appl. No.: 176,282

[22] Filed: Dec. 30, 1993

Related U.S. Application Data

[63] Continuation of Ser. No. 863,945, Apr. 6, 1992, abandoned.

[51] Int. Cl.[6] ..... E02B 17/00

[52] U.S. Cl. ..... 405/209; 405/196; 405/203; 405/204

[58] Field of Search ..... 405/209, 195.1, 196–200, 405/203, 204; 175/5–7

[56] References Cited

U.S. PATENT DOCUMENTS

| | | | |
|---|---|---|---|
| 1,894,950 | 1/1933 | Fitch . | |
| 2,489,869 | 11/1949 | Dunn | 214/38 |
| 2,644,971 | 7/1953 | Rowe | 14/71 |
| 2,934,905 | 5/1960 | Woolslayer et al. . | |
| 2,959,015 | 11/1960 | Beck . | |
| 2,997,852 | 8/1961 | Suderow . | |
| 3,001,595 | 9/1961 | Lucas | 175/9 |
| 3,011,318 | 12/1961 | Ashton . | |
| 3,033,525 | 5/1962 | Johnson | 254/107 |
| 3,150,787 | 9/1964 | Patrignani | 214/514 |
| 3,477,235 | 11/1969 | Branham et al. . | |
| 3,716,993 | 2/1973 | Sumner . | |
| 3,894,503 | 7/1975 | McClure . | |
| 3,931,778 | 1/1976 | Miller et al. . | |
| 3,952,887 | 4/1976 | Lutz | 214/38 C |
| 4,055,264 | 10/1977 | Abbott | 214/152 |
| 4,065,934 | 1/1978 | Dysarz . | |
| 4,103,503 | 8/1978 | Smith | 405/196 |
| 4,224,005 | 9/1980 | Dysarz | 405/209 X |
| 4,252,469 | 2/1981 | Blight et al. | 405/204 |
| 4,269,542 | 5/1981 | Mueller | 405/196 |
| 4,456,404 | 6/1984 | Evans | 405/203 X |
| 4,473,321 | 9/1984 | Culver et al. | 405/3 |
| 4,483,644 | 11/1984 | Johnson | 405/201 |
| 4,583,881 | 4/1986 | Steele | 405/198 |
| 4,602,894 | 7/1986 | Lorenz et al. | 405/203 |
| 4,729,695 | 3/1988 | Silvestri | 405/209 X |
| 4,826,355 | 5/1989 | Marion | 405/209 |
| 4,848,967 | 7/1989 | Weyler | 405/204 |
| 4,864,957 | 9/1989 | Edgar et al. | 114/258 |
| 4,874,269 | 10/1989 | Dysarz | 405/209 |
| 4,938,628 | 7/1990 | Ingle | 405/196 X |
| 4,973,198 | 11/1990 | Cox | 405/196 X |
| 5,032,040 | 7/1991 | Ingle | 405/201 |
| 5,052,860 | 10/1991 | Ingle | 405/201 |

FOREIGN PATENT DOCUMENTS

| | | | |
|---|---|---|---|
| 0094434 | 6/1983 | European Pat. Off. | 405/209 |
| 1214760 | 11/1959 | France | 405/209 |
| 2405182 | 4/1979 | France . | |
| 1462775 | 2/1977 | United Kingdom . | |
| 2022521 | 12/1979 | United Kingdom . | |

OTHER PUBLICATIONS

"A New Concept For Moving Heavy Loads"; Shipbuilding and Shipping Record, May 19, 1972, pp. 29–30.

"Rowan Gorilla IV"; Rowan Companies, Inc., Houston, Tex.

"The Manitowoc Ringer Concept"; Manitowoc Engineering Co., Manitowoc, Wis., 1974.

"Rowan Skid-Off Option"; Rowan Companies, Inc., Houston, Tex., May 4, 1992.

Abstract of Japanese Patent No. 59-91209(A), May 25, 1984.

*Primary Examiner*—Dennis L. Taylor

*Attorney, Agent, or Firm*—Fish & Richardson

[57] ABSTRACT

A method and apparatus for transporting and using a drilling apparatus or a construction crane apparatus from a single moveable vessel is provided. Either a drilling apparatus or a construction crane apparatus is skidded onto the deck of a jack-up rig which is then floated to a remote location for use of the apparatus. The skidding of the construction crane apparatus is facilitated by a new and unique pony structure to raise the base of the construction crane apparatus above a skid on the jack-up rig.

27 Claims, 21 Drawing Sheets

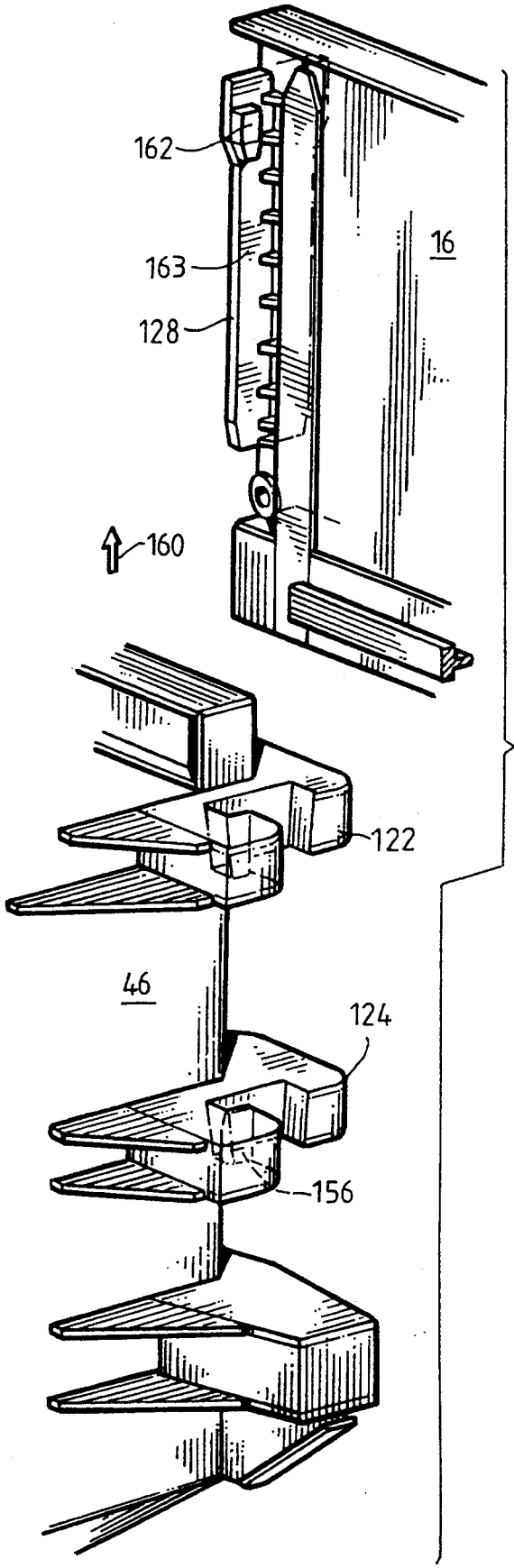
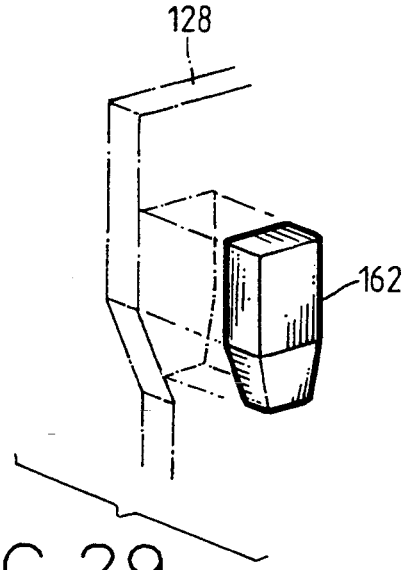
FIG.29
FIG.28
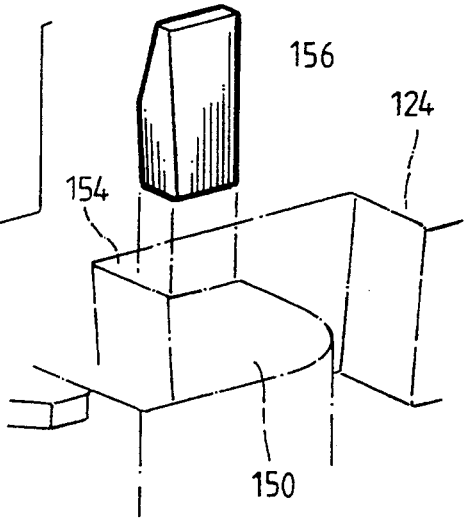
FIG.30

METHOD AND APPARATUS FOR TRANSPORTING AND USING A DRILLING APPARATUS OR A CRANE APPARATUS FROM A SINGLE MOVABLE VESSEL

Related Applications

This application is a continuation of application Ser. No. 07/863,945, filed Apr. 6, 1992, now abandoned.

This application is related to co-pending application Ser. No. 609,927 filed Nov. 6, 1990.

1. Field of the Invention

This invention relates generally to a method and apparatus for transporting and/or using a drilling apparatus or a crane apparatus from a single movable vessel, and, more particularly, to a method and apparatus for utilizing a conventional jack-up rig as both a transportation barge and work platform for drilling operations or high capacity crane operations.

2. Description of the Related Art

There are two main activities that are performed in a remote, sub-sea oil field. The first of these activities is construction and demolition of fixed platforms. The second of these activities is the drilling or work-over of oil wells. The construction and demolition of platforms is a labor intensive activity and requires specially designed, high capacity construction cranes to lift the building materials necessary for fixed platforms. The specially designed, high capacity cranes are often required to lift loads between 450 and 1,000 tons.

It is presently common for cranes of this capacity, hereafter referred to as "construction cranes", to be mounted upon sea-going barges. Individual barges are therefore dedicated as construction barges. However, those of ordinary skill in the art will appreciate that a barge-mounted crane will roll, pitch, and yaw with the sea surface. This movement adversely affects the ability of a construction crane to safely and accurately lift large loads. This problem is compounded when the load to be lifted is also affected by the motion of the water, e.g., when the load is on a different barge. Indeed, it is not uncommon for a construction crane barge to wait for 30 days or more in a remote field location before the seas are calm enough to utilize the crane. Moreover, even land-based construction cranes are sensitive to even slight deflections in their support structures. Thus, it has long been desired to eliminate these problems associated with construction cranes.

In addition to using construction crane barges to build or demolish fixed platforms, construction crane barges are also utilized to lift onto the platform the pieces of a drilling package comprising the drilling derrick and other related drilling apparatus to drill or work-over an oil well. However, because of the heavy loads associated with this drilling package, construction crane barges are not ideally suited to this task.

Moreover, the prior art practice of using dedicated construction crane barges requires that a multiplicity of barges be available for a given remote field location to accomplish the tasks of construction and drilling.

Others have attempted to overcome these limitations of the prior art. For example, U.S. Pat. No. 4,103,503, issued Aug. 1, 1978 to Marvin L. Smith, describes a method and apparatus for transferring a drilling apparatus from a jack-up platform to a fixed platform thereby eliminating the need of the construction crane barge for this purpose. While a definite advance over other prior art systems, the Smith method and device is a manual, time consuming operation. Moreover, utilizing the Smith improvement still requires that a construction crane barge be dedicated to a remote field location for the construction and demolition of fixed platforms.

It has long been desired to eliminate altogether the need for a construction crane barge being dedicated to a remote field location. However, prior to the present invention, no one has been able to fashion a solution to this and other limitations of the prior art.

SUMMARY OF THE INVENTION

In one aspect of the present invention, a construction crane package suitable for skidding on and off skid rails on a jack-up rig is provided. The base of the construction crane is wider than a skid fairway defined by the skid rail width and length on the jack-up rig. The improvement comprises a "pony" upon which the construction crane rides. The pony includes a plurality of beams of sufficient length and strength to support the construction crane, the beams being substantially parallel to each other and spaced apart a width that facilitates introducing the pony into the skid fairway on the jack-up rig. A plurality of support structures within the pony are provided that raises the base of the construction crane to an elevated zone above the skid fairway. The elevated zone has a width at least as great as the width of the base of the construction crane and a length corresponding to the length of the skid fairway. The elevated zone is above any obstacles present on the jack-up rig platform. This arrangement facilitates skidding the construction crane on and off the jack-up rig and over obstacles adjacent the skid fairway. The support structures are suitable to support an overhang of the construction crane base. This overhang is caused by the construction crane base being wider than the width of the skid fairway. Further, the support structures have rigidity sufficient to facilitate operation of the construction crane from the elevated zone when the jack-up rig is jacked-up. The support structures are sufficiently lightweight to facilitate the raising and lowering of the jack-up rig.

Another aspect of the present invention entails a method of providing a construction crane at a construction site comprising the steps of providing a jack-up rig having a hull and a plurality of legs adapted for movement relative to the hull, with the hull having a platform or deck; skidding a construction crane package onto the deck of the hull; floating the jack-up rig to a first location for the use of the crane; lowering the legs of the jack-up rig to secure the deck; operating the construction crane package at the first location; raising the legs of the jack-up rig to float the hull; floating the jack-up rig to a second location; and skidding the construction crane package off of the deck of the jack-up rig at the second location.

Yet, another aspect of the invention entails a method of providing construction, demolition and drilling from a jack-up rig, comprising the steps of providing a jack-up rig having a hull and a plurality of legs adapted for movement relative to the hull, with the hull having a deck; skidding a construction crane package onto the deck of the jack-up rig; floating the jack-up rig to a first location for the use of the crane; lowering the legs of the jack-up rig to secure the deck; operating the construction crane package at the first location to perform construction or demolition; raising the legs of the jack-up rig to float the hull; floating the jack-up rig to a second location suitable for storage of the construction crane package; skidding the construction crane package off of the jack-up rig at the second location; skidding a drilling package onto the deck of the jack-up rig; floating the jack-up rig to a third location for use of the drilling package; lowering the legs of the jack-up rig to secure the deck; operating the drilling package at the third location to perform drilling or work-over; and, raising the legs of the jack-up rig to float the hull.

BRIEF DESCRIPTION OF THE DRAWINGS

Other objects and advantages of the invention will become apparent upon reading the following detailed description and upon reference to the drawings in which:

FIG. 28 illustrates an exploded perspective view of the blade member and guide assembly of the lock;

FIG. 29 illustrates an exploded perspective view of an upper rear face of the blade member, including a cam surface; and FIG. 30 illustrates an exploded perspective view of the lower guide member, including a cam surface.

Figure 1:
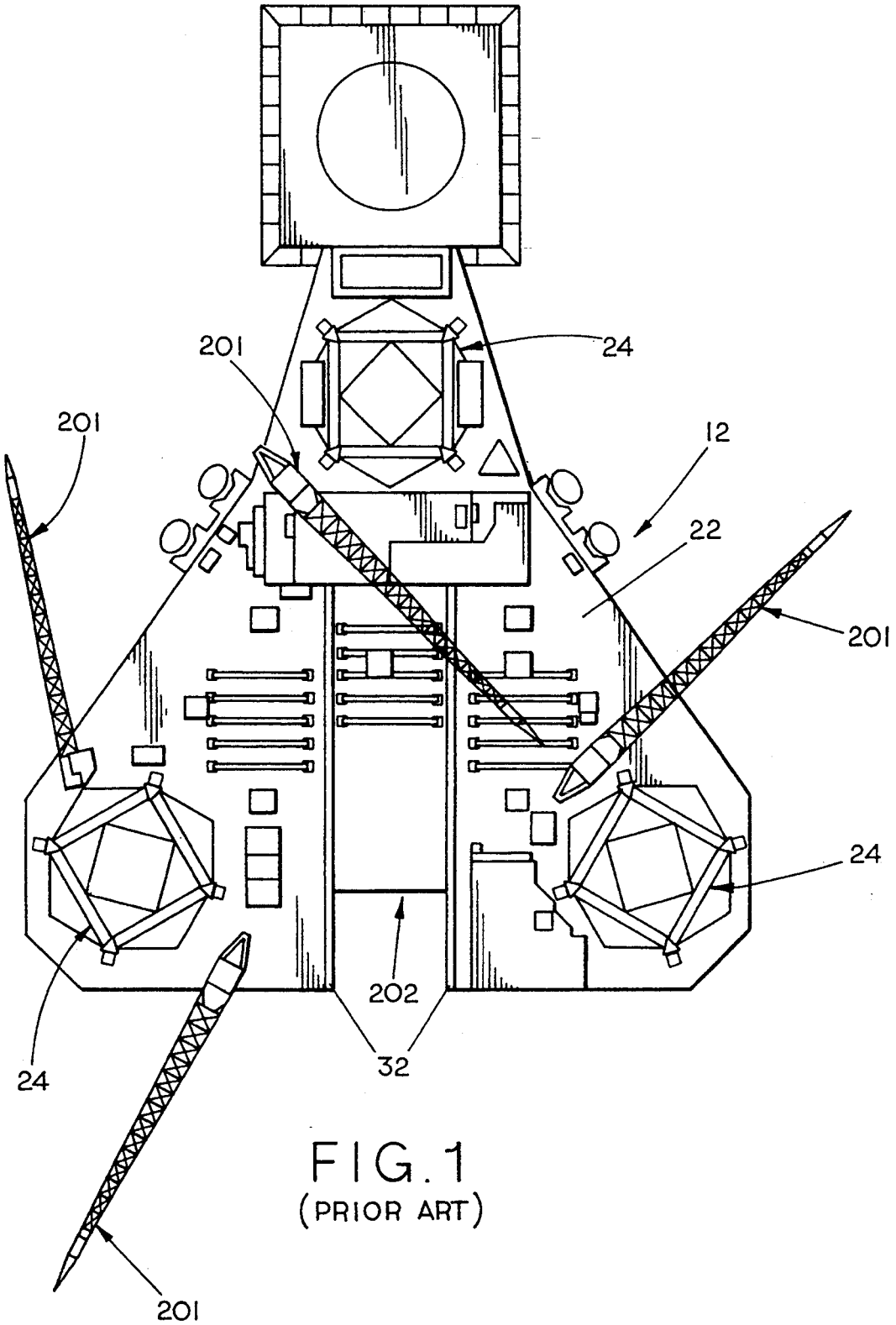
FIG. 1 (PRIOR ART)
FIG. 1 illustrates an overhead view of a conventional jack-up rig.

While the present invention is susceptible to various modifications and alternative forms, a specific embodiment thereof has been shown by way of example in the drawings and will herein be described in detail. It should be understood, however, that this specification is not intended to limit the invention to the particular form disclosed herein, but on the contrary, the intention is to cover all modifications, equivalents, and alternatives falling within the spirit and scope of the invention, as defined by the appended claims.

DESCRIPTION OF THE PREFERRED EMBODIMENT

Referring now to the drawings it will be appreciated by those of skill in the art that a conventional jack-up rig 12 is illustrated in FIG. 1. Skid rails 32 are shown which enable the skidding on and skidding off of equipment as will be discussed more fully below. Supply cranes 201 are typically provided on such jack-up platforms. However, supply cranes are usually limited to a lifting capacity of between 45 and 100 tons. Supply cranes of this type do not have sufficient lifting capacity to function as construction cranes in remote, deep water fields. Also shown is slot 202 which is useful for encompassing fixed platforms 14 (e.g., FIG. 10) of suitable size during work-over operations as is well known by those of ordinary skill in the art.

The jack-up rig 12 can take the form of any of a wide variety of such structures. It is sufficient for purposes of understanding this invention that the jack-up rig 12 be capable of two basic functions. First, the jack-up rig 12 includes a hull 20 (e.g., FIG. 6) that is sufficiently sealed against water intrusion that it is able to float on the surface of a body of water, such as the Gulf of Mexico. In this manner, the jack-up rig is readily transportable by floatation to a variety of locations.

Second, the jack-up rig 12 must necessarily include means for adjusting its platform or deck 22 to a variety of vertical heights. Preferably, the jack-up rig 12 includes a plurality of leg members 24 that are movably connected to the hull 20 and can be raised and lowered at will. For example, when it is desired that the jack-up rig 12 be floated to a new location, the leg members 24 are raised above the sea floor 26, allowing the hull 20 to float freely on the surface of the water. On the other hand, when it is desired that the deck 22 be raised to a height, the leg members 24 are lowered, engaging the sea floor 26 (e.g., FIG. 6) and slowly raising the height of the deck 22 to a desired level.

Raising and lowering the leg members 24 may be accomplished in any suitable manner, such as electric, hydraulic, pneumatic, or even internal combustion motors (not shown) connected by means of a pinion or other well known structures to a rack or series of racks (not shown) disposed on the leg members 24.

Jack-up rigs 12 of this type when jacked-up provide a stable platform from which to conduct drilling or workover operations. Because jack-up rigs can also be jacked-down and operated as barges, they have proved useful in transporting drilling packages between various platforms in remote locations. Heretofore, however, no one has been able to utilize a conventional, jack-up rig 12 to accomplish both drilling and construction crane functions. This is attributable to a number of reasons, including the size weight, and sensitivity to movement of conventional construction cranes.

Figure 2:
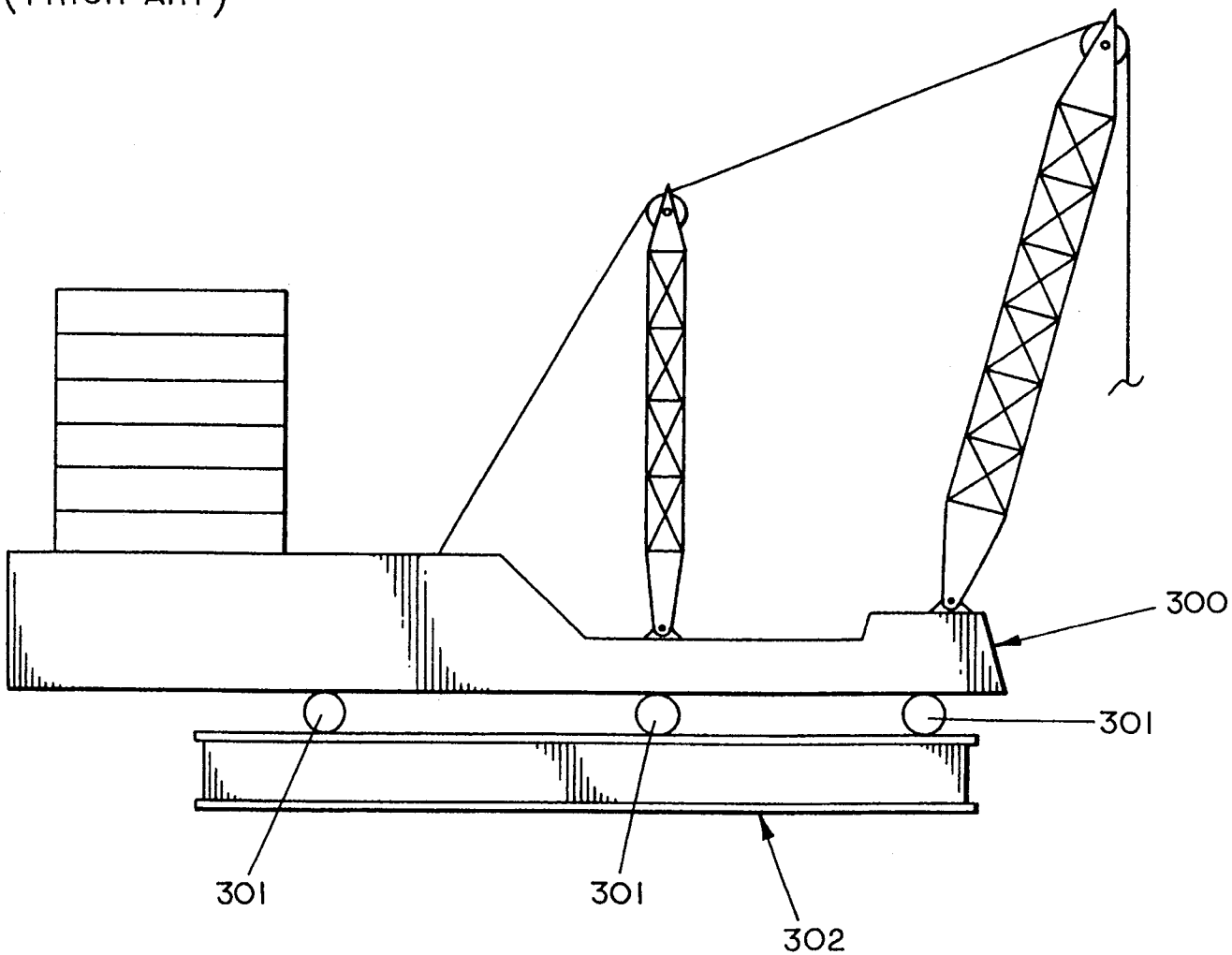
FIG. 2 (PRIOR ART)
FIG. 2 schematically depicts a side elevation of a conventional construction crane.

Illustrated in FIG. 2 is a schematic depiction of a side elevation of a conventional construction crane 300. The crane 300 is typically designed to roll upon rollers 301 on top of a base or ring 302. Typically, the diameter of ring 302 is 60 feet or greater. Construction cranes of this type are very susceptible to differential movement in the ring 302 in addition to movement generally. Some conventional construction cranes with large diameter rings 302 can tolerate less than $\frac{3}{8}$ of an inch deflection in the ring. This sensitivity to even slight deflections, as pointed out earlier, inhibits the use of a high capacity construction crane on a floating construction barge. Similarly, the size and weight of such conventional construction cranes and the deck space required for the large diameter ring 302 has heretofore prevented their use upon even the larger, more stable jack-up rigs of the type illustrated in FIG. 1.

It will be appreciated by those of ordinary skill in the art that the skid rails 32 (FIG. 1) utilized by conventional jack-up rigs 12 define a skid fairway of fixed width, length, and unlimited height. Anything skidded along the deck 22 of jack-up rig 12 must not extend beyond this skid fairway. Otherwise, equipment that extends beyond the boundaries of the skid fairway would contact, and therefore cause damage to, other components of the jack-up rig 12. It is therefore a requirement of skidding that anything skidded move only within the skid fairway of the jack-up rig.

However, the ring 302 of conventional construction cranes is wider than conventional jack-up rig skid fairways. Thus, the prior art provides no way for construction cranes to be skidded on and off of conventional jack-up rigs. The present invention surmounts this problem by attaching the ring 302 to a new and unique pony 304 comprising a ring substructure 303. The pony 304, including the ring substructure 303, and the construction crane 300 (including ring 302) are sometimes referred to herein as a construction crane package.

Figure 4:
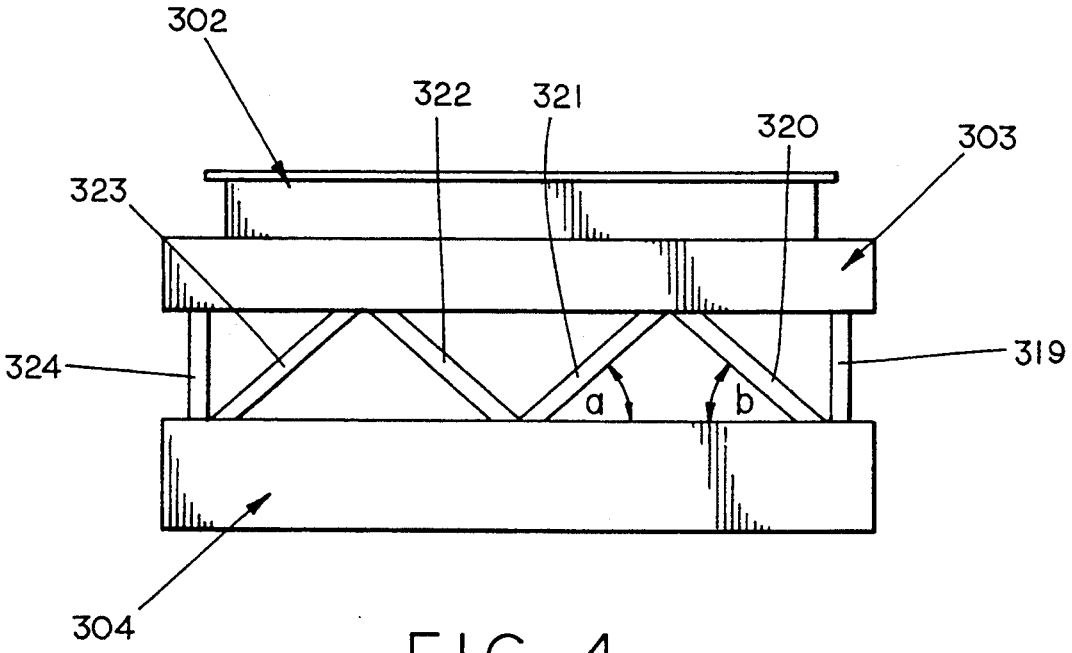
FIG. 4 illustrates a side view of the lower section of a construction crane mounted atop a pony.
Figure 5:
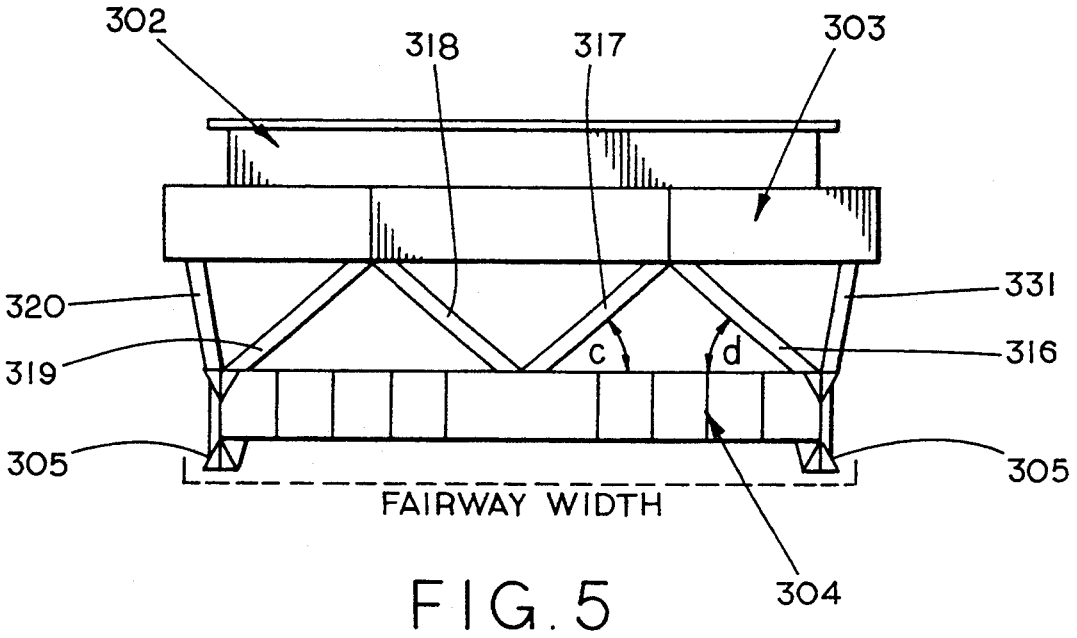
FIG. 5 illustrates a front view of the overhang of the lower section of the construction crane and the pony.

Referring now to FIGS. 4 and 5, crane ring 302 is seen attached to an eight-sided ring substructure 303 which comprises the pony 304. FIG. 5 shows the width of the skid fairway in relation to the ring substructure 303 of pony 304. It is seen that the pony 304 elevates the ring 302 into a previously unappreciated zone above the skid rails 32. This new elevated zone has a greater unobstructed width than the conventional skid fairway. In this manner, the ring substructure 302, which would otherwise extend beyond the skid fairway width, is raised into a new fairway in an elevated zone above the conventional skid fairway which facilitates the movement of the construction crane package on and about jack-up rig 12.

Because of the enormous weight of typical construction cranes 300 (around 3 million pounds), and the sensitivity of these cranes to differential movement of the ring 302, the support structure of the pony 304 must meet the conflicting requirements of rigidity and lightweight.

Figure 3:
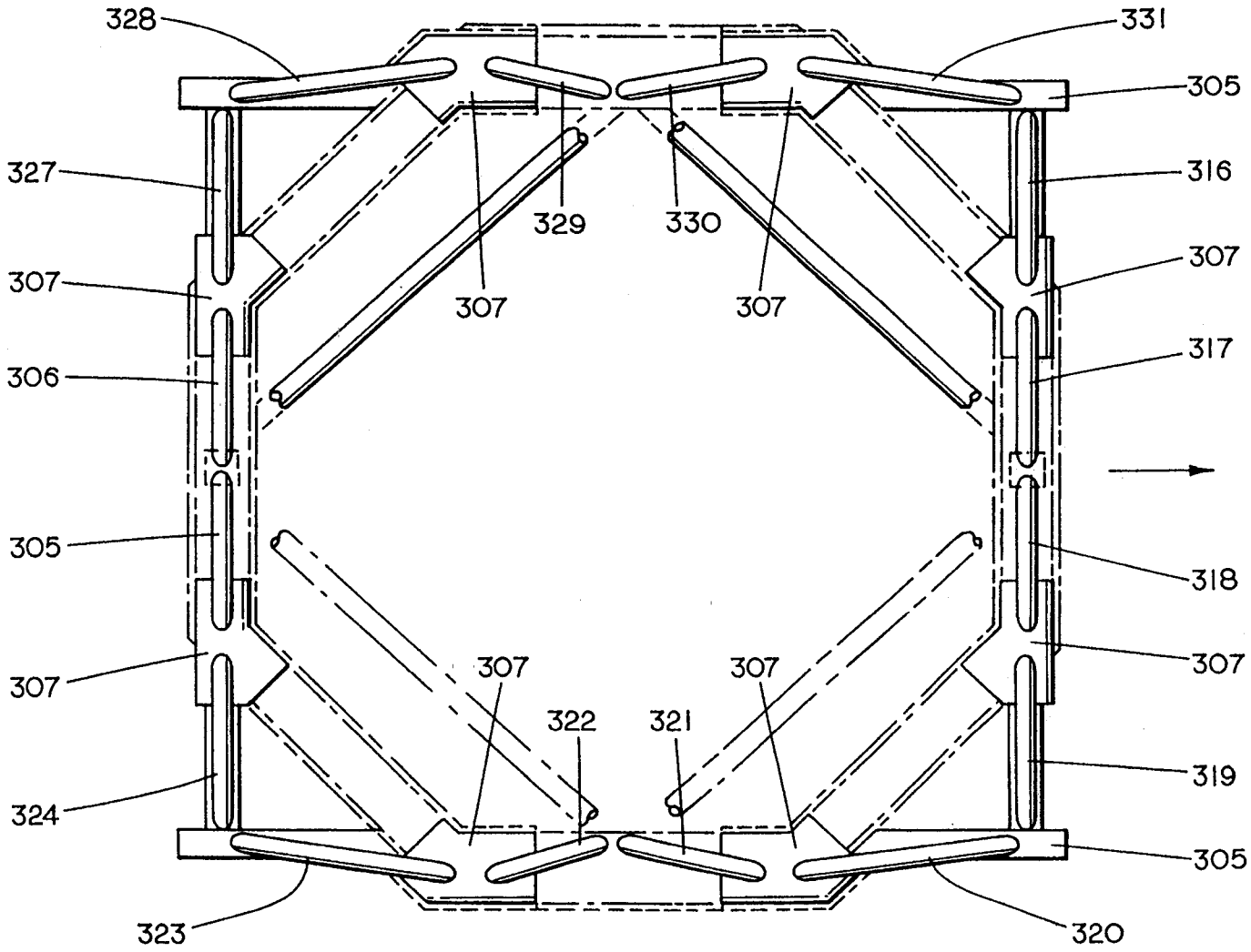
FIG. 3 illustrates a top view of the lower section of a construction crane mounted atop a pony.

FIG. 5 is a front view of ring substructure 303 of pony 304 in which the underlying support structure is more readily discernable. Beams (or rails) 305 are shown and are understood to be conventional in design and construction to facilitate the skidding of the pony 304 along the skid rails 32 of jack-up rig 12. An arrow in FIG. 3 shows the direction of movement of the pony as it leaves the jack-up rig 12. Ring substructure 303 is, in one preferred embodiment, an eight-sided structure with eight nodes or plates 307.

In a preferred embodiment, the lightweight yet rigid pony 304 is fabricated from tubular metal product such as 16" outside diameter pipe ($1\frac{1}{4}$" wall thickness). It is preferred that such tubular product be fabricated from a high strength, low alloy steel (e.g., ANSI 4300-series steel) that exhibits a yield strength of about 90 ksi and yet retains adequate ductility and toughness. However, those of ordinary skill in the art having benefit of this disclosure will appreciate that different materials may suffice depending upon known design criteria for a specific application.

FIGS. 3, 4 and 5 depict a preferred embodiment in which sixteen tubular members 316–331 intersect the ring 302 at each of the eight nodes 307. Further, it is seen that the sixteen tubular members 316–331 can be grouped into four sets of four. Sets 1 and 2 comprise tubular members oriented generally normal to the direction of travel of the pony when skidding off the jack-up rig 12. Sets 1 and 2 include tubular members 316, 317, 318, 319, 324, 325, 326, and 327. Sets 3 and 4 comprise tubular members oriented generally parallel to the direction of travel of the pony when skidding off the jack-up rig 12. Sets 3 and 4 include tubular members 320, 321, 322, 323, 328, 329, 330, and 331.

FIGS. 3, 4 and 5 show that the tubular members of sets 1 and 2 all lie within a plane normal to beams 305. In other words, the tubular members of Sets 1 and 2 do not extend out of the vertical plane in which they rest. In the preferred embodiment, support structures 316, 319, 322, and 324 make an angle of 50.5° with a horizontal axis; support structures 317, 318, 325, and 326 make an angle of 54.5° with the horizontal axis. Reference is made to FIG. 4 that shows that the length of the pony 304 is substantially the same as the length of the ring 302.

Tubular members from Sets 3 and 4, however, do not all lie in a single vertical plane. FIG. 3 shows that tubular members 320, 321, 322, 323, 328, 329, 330, and 331 are angled from the beams 305 up to the nodes 307. In the preferred embodiment, support structures 320, 323, 328, and 331 make an angle of 44° with a horizontal and 12° with a vertical axis; support structures 321, 322, 329 and 330 make and angle of 55.5° with a horizontal axis and 8° with a vertical axis. Reference is made to FIG. 5 that shows that the width of the pony 304 is less than the width of the ring 302.

The preferred embodiment of the pony 304 described herein facilitates the raising of the crane ring 302 out of the undersized skid fairway and into an elevated zone of sufficient width for the skidding on and off of a construction crane package. There may be other pony structures capable of raising of the crane ring 302 out of the undersized skid fairway and into an elevated zone of sufficient width. For example, rather than only the width of the ring 302 overhanging the pony 304, both the width and length could overhang the pony. However, other pony structures must be sufficiently rigid to meet conventional construction cranes limits on differential movement of the ring 302 and yet not be so heavy as to exceed the lifting capacity of a jack-up rig 12.

The present invention facilitates the use of a conventional jack-up rig as both a construction crane platform relatively unaffected by the weather and movement of the seas, and a drilling or work-over platform. The present invention facilitates the operation of a crane package in the same weather criteria as a jack-up rig. For example, a crane package utilizing the present invention has been rated for a 15 year return storm in the Gulf of Mexico.

Figure 6:
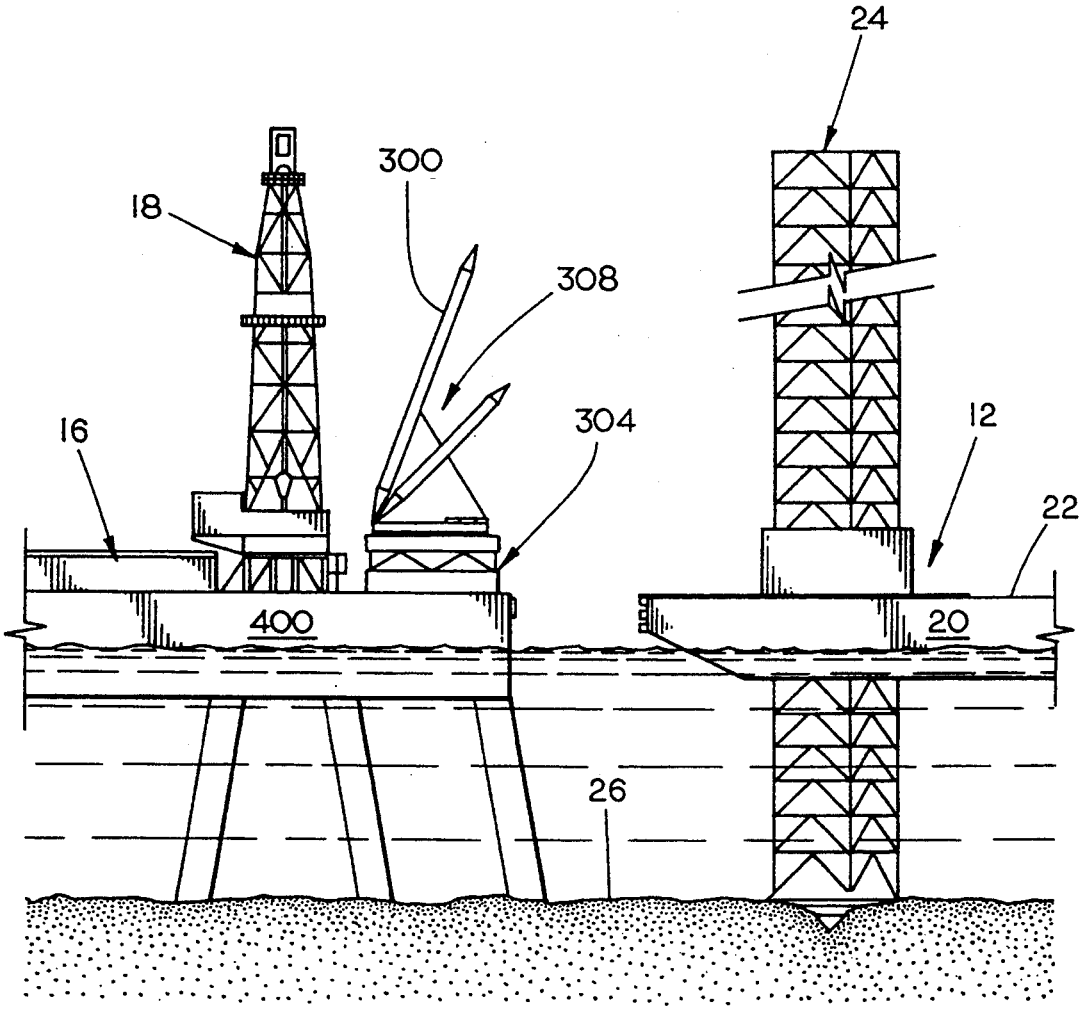
FIG. 6 illustrates a conventional jack-up rig adjacent a dock on which sits a construction crane package, a drilling package, and a skidbase.

As shown in FIG. 6, the jack-up rig 12 is adjacent a dock 400 that has a conventional construction crane 300 mounted atop a pony 304 according to the present invention. Also shown on the dock 400 is a drilling package 18 and a skidbase 16. The skidbase 16 is more fully described below.

The construction crane package 308 which comprises the conventional construction crane 300 and pony 304 is shown to be in the cribbed position for transportation. Also note that the crane counterweights (not shown) are not on the crane package 308 and will be transported on the deck of the jack-up rig 12 separately from crane package 308. Crane package 308 may be skidded on jack-up rig 12 and moved to a position sufficiently inboard on the deck 22 to facilitate transportation by floatation to a remote location.

Figure 7:
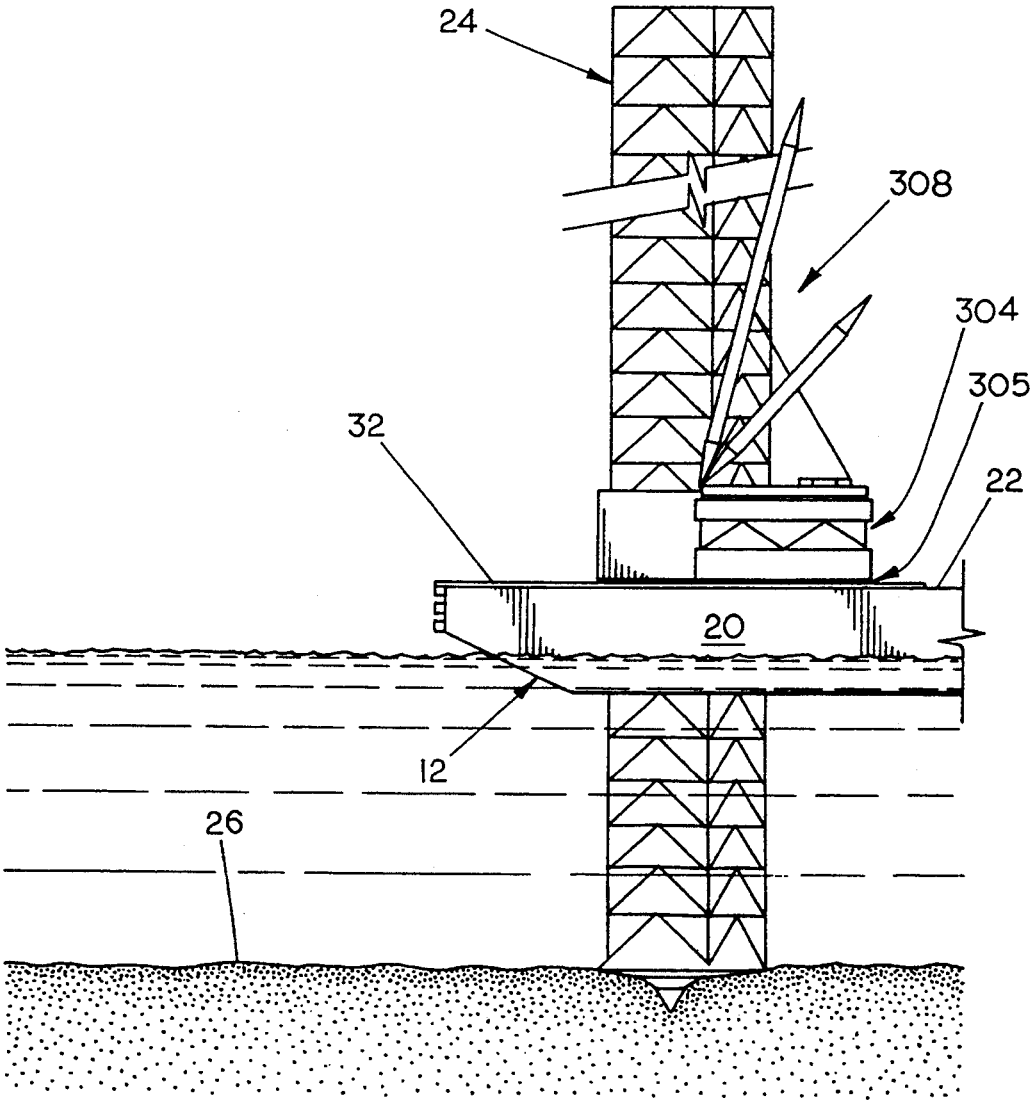
FIG. 7 illustrates a conventional jack-up rig with a construction crane package thereon at a remote field location.

FIG. 7 depicts the construction crane package 308 after it has been skidded onto the jack-up rig 12. Transferring the construction crane package from the dock onto the jack-up rig 12 involves skidding the construction crane package 308 along a set of rails 32 located on the deck 22 of the jack-up rig 12. This skidding process is accomplished using power commonly available on jack-up rigs 12 such as winches and hydraulic motors (not shown). Preferably, the pony 304 is secured to the construction crane by a rigid yet lightweight structure that transfers loads evenly to the contact surfaces of the skid rails 305 and 32.

Figure 8:
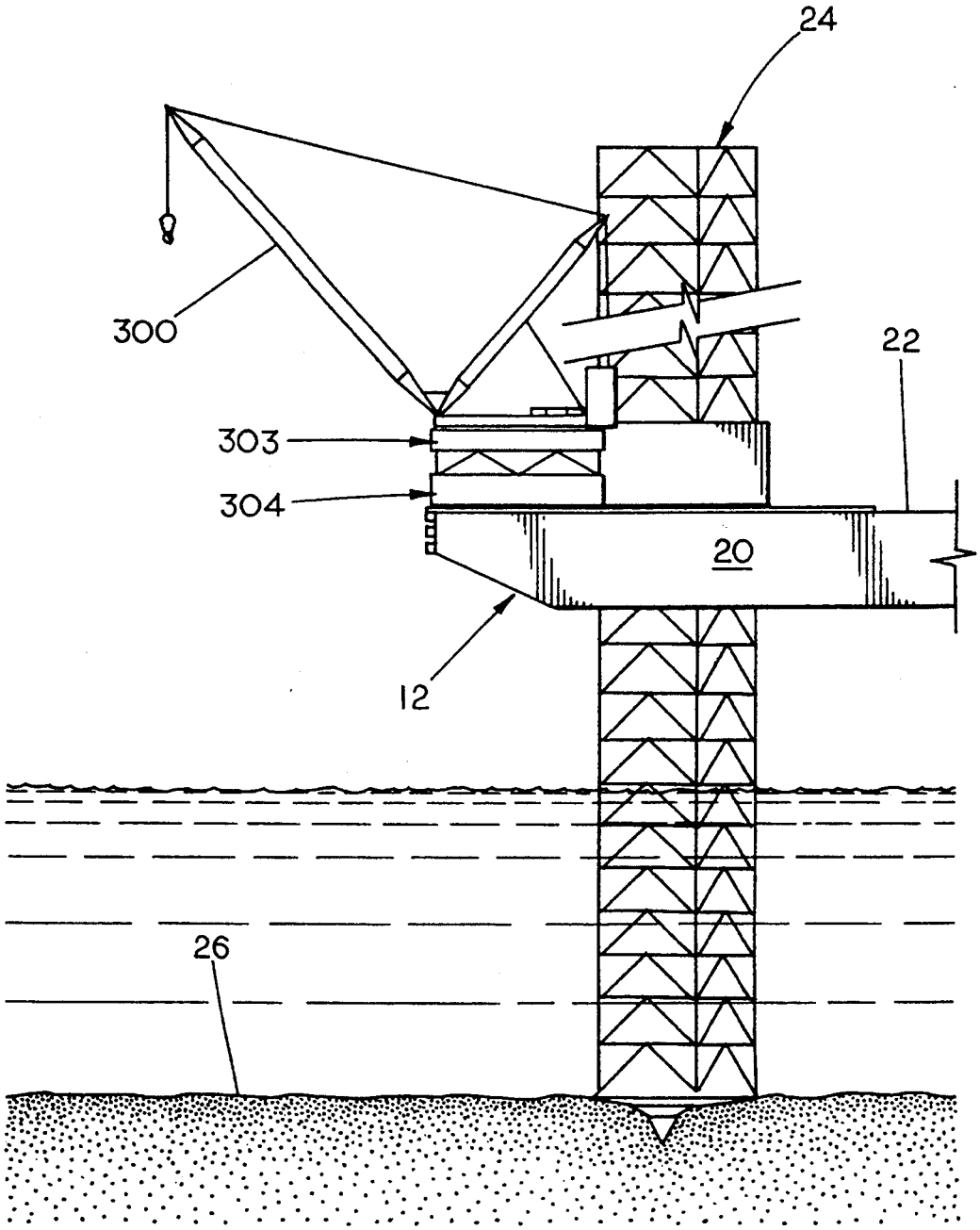
FIG. 8 illustrates the jack-up rig in a jacked-up configuration with the construction package ready for lifting.

FIG. 8 illustrates the jack-up platform in a raised position located in a remote sub-sea oil field. The crane package is shown skidded forward into position over the platform slot 202 (FIG. 1). The transportation cribbing has been removed from the crane package, the counterweights installed and the construction crane package 308 otherwise readied for service. It will be appreciated by those of skill in the art having benefit of this disclosure that the raised jack-up rig provides a relatively stable secure deck or platform from which the crane package can operate. The raised deck 22 of the jack-up rig is relatively unaffected by the wave and tidal action of the seas and is therefore relatively unaffected by the weather conditions of the remote maritime location.

Figure 9:
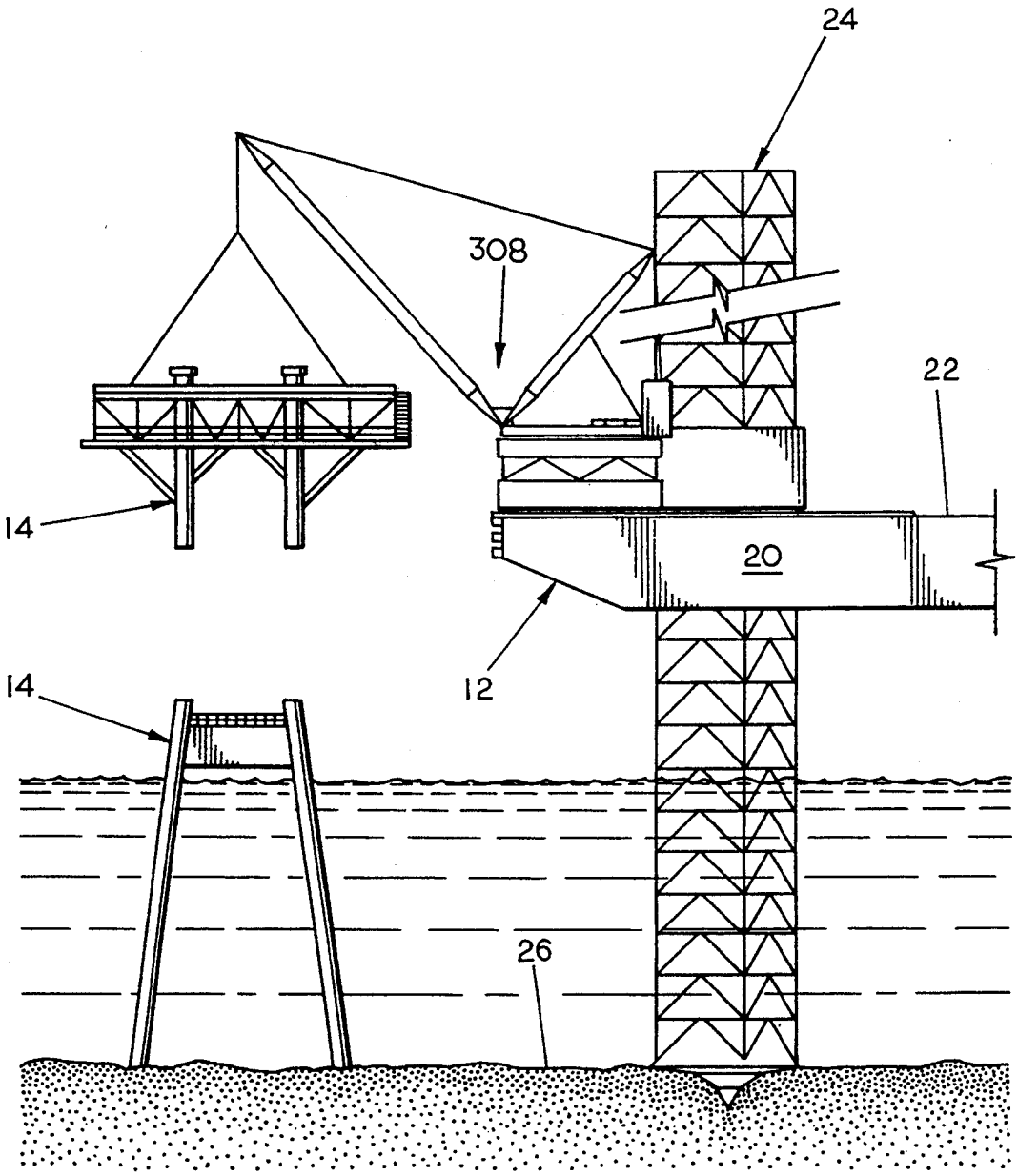
FIG. 9 illustrates the construction crane package atop the conventional jack-up rig assembling a fixed platform.

FIG. 9 illustrates the construction package 308 being used from the raised deck 22 of a conventional jack-up rig 12 to construct a fixed platform 14. It should be appreciated that the present invention is not restricted to merely construction of fixed platforms but may also be used for the demolition of existing platforms.

Figure 10:
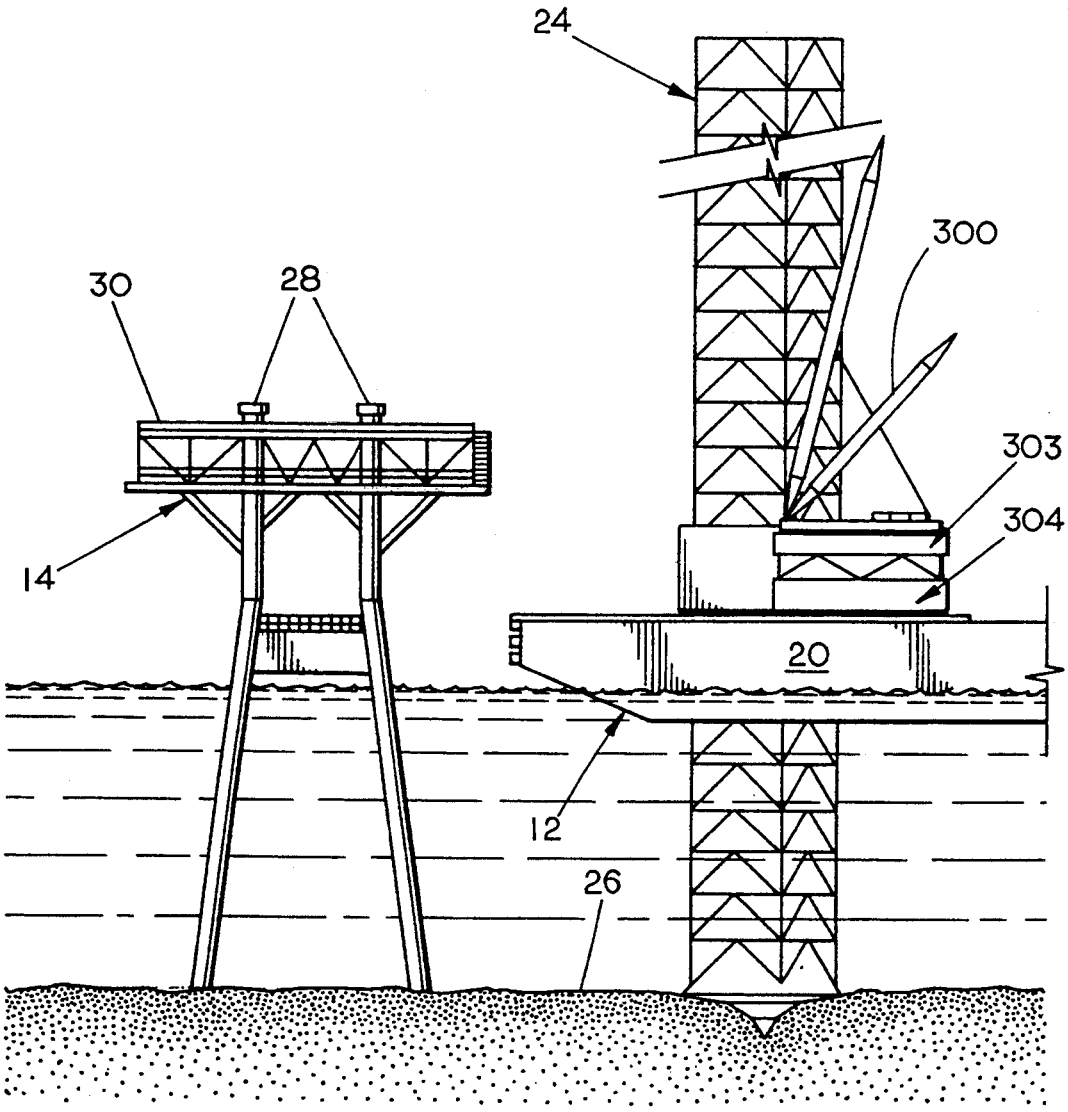
FIG. 10 illustrates the conventional jack-up rig in near floating condition adjacent a completed fixed platform with the crane package cribbed for transportation.
Figure 11:
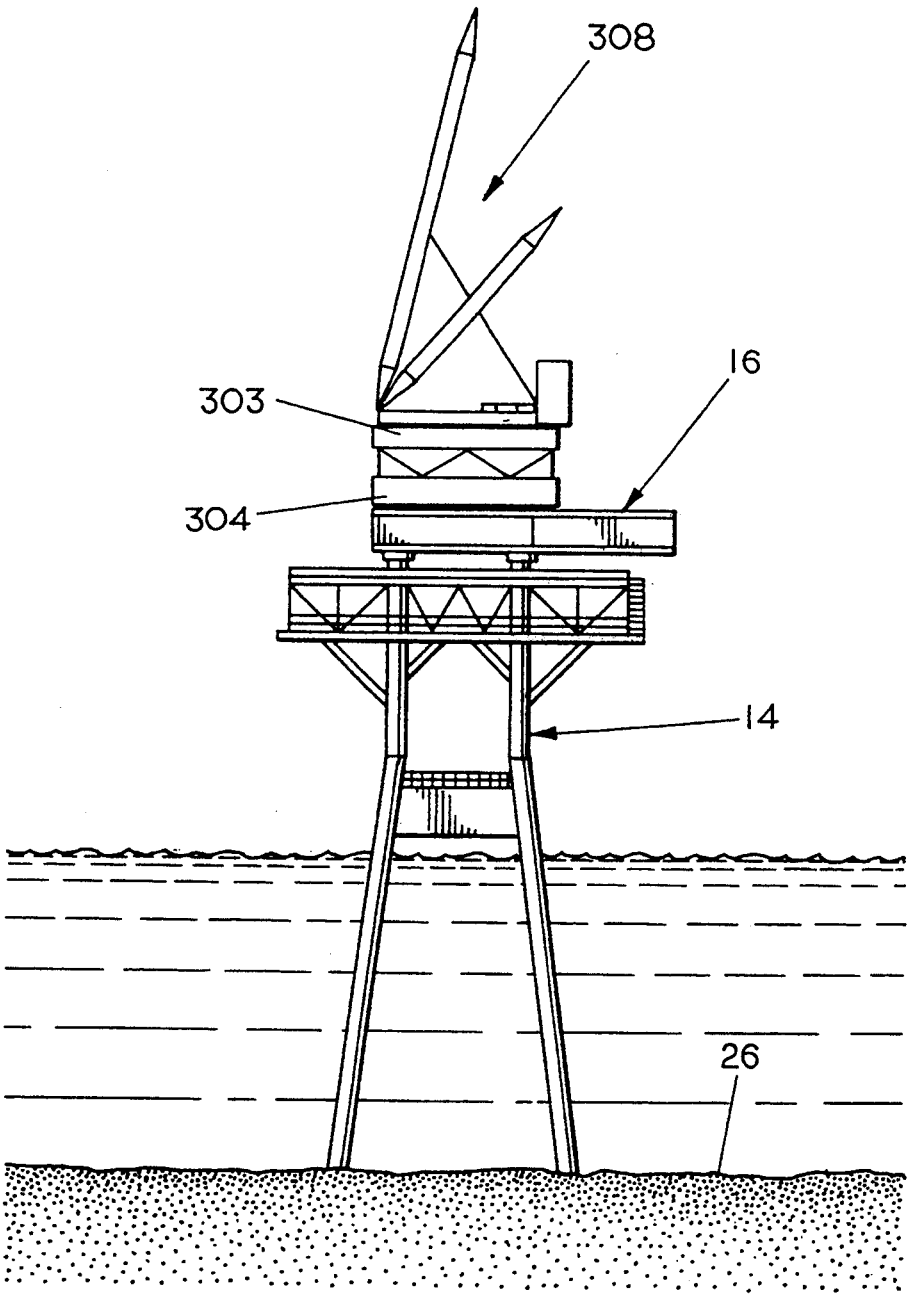
FIG. 11 illustrates a construction crane package stored atop a fixed platform.

FIG. 11 illustrates the hull 20 in the near floating condition after finalizing construction of the fixed platform 14. FIG. 10 also illustrates that the crane package 308 has been cribbed for transportation and has been skidded back into its traveling location. Once the jack-up rig 12 is in the fully floating configuration, the rig can be transported to another construction site for the construction or demolition of a fixed platform 14 or, the jack-up rig can return to the dock 400 indicated generally in FIG. 6.

The construction crane package 308 can be skidded off or otherwise replaced on the dock 400, and the drilling package 26 and skid base 16 can be loaded onto the jack-up platform. If the drilling package is loaded onto the jack-up rig 12, the jack-up rig can then be returned to, for example, the fixed platform 14 shown in FIG. 9, and the drilling package can be skidded off onto the fixed platform.

In remote regions where the dock 400 is too far away to be a convenient venue to store the crane package, the crane package 308 can be skidded onto and stored atop a fixed platform 14 as shown in FIG. 11. While the crane package 308 is stored, the jack-up rig can be used with a drilling package to drill or work-over wells. When drilling or workover has been completed, the drilling package can be skidded off onto and may be stored atop a fixed platform 14.

Thus, the present invention provides for the first time, a method and apparatus that facilitates the use of a single moveable structure, such as a conventional jack-up rig, to serve a dual function as a fixed drilling platform and as a fixed construction crane platform that is relatively unaffected by the wave and tidal action of the maritime environment.

Referring now to FIGS. 12–30, a new method of transferring a drilling package 10 or crane package 308 from a jack-up rig 12 to a fixed platform 14 is described. Preferably, the transfer method for the drilling package 10 occurs in two major steps: (1) sliding a skidbase 16 from the jack-up rig 12 to the fixed platform 14; and (2) sliding a drilling structure 18 from the jack-up rig 12 onto the skidbase 16.

Figure 12:
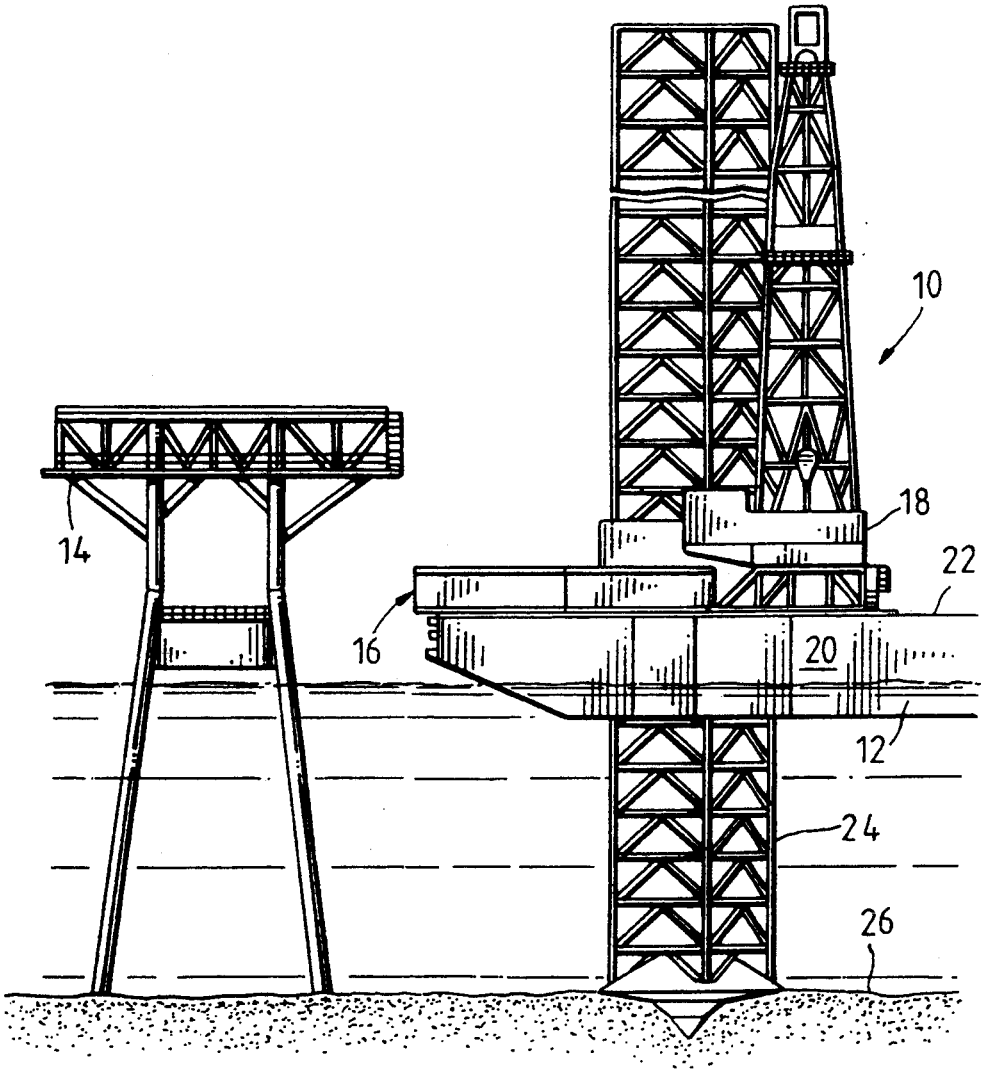
FIG. 12 illustrates a jack-up rig, which has a drilling package and a skidbase located thereon, positioned adjacent a fixed platform.

FIG. 12 illustrates the jack-up rig 12 positioned immediately adjacent the fixed platform 14 with sufficient horizontal spacing therebetween to allow the deck 22 and skidbase 16 to clear the fixed platform 14 as it is raised to its proper vertical height. The leg members 24 are shown lowered to a position where the sea floor 26 is initially engaged. While only a single leg member 24 is illustrated in the drawing, it is readily understood by those skilled in the art that at least three leg members 24 are present to ensure stability of the jack-up rig 12.

Figure 13:
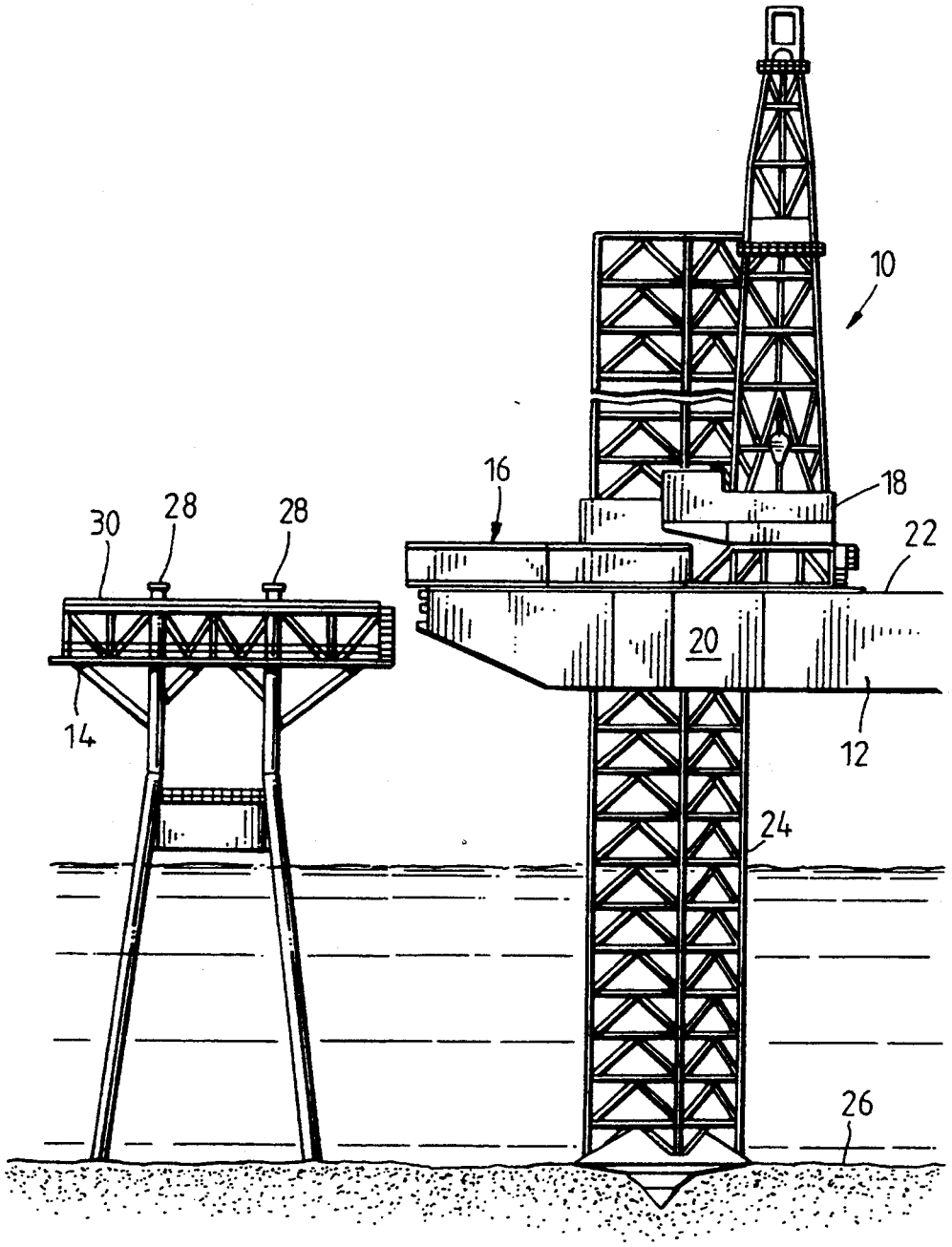
FIG. 13 illustrates the jack-up rig raised to the proper height for transferring the skidbase from the jack-up rig deck to the fixed platform.

FIG. 13 shows the deck of the jack-up rig 12 raised to the proper height for transferring the skidbase 16 from the jack-up rig 12 to the fixed platform 14. In particular, the height of the deck 22 is substantially, vertically aligned with a pair of capping beams 28, which extend across a deck portion 30 of the fixed platform 14 and are preferably positioned transverse to the major components of the skidbase 16 to provide adequate support therefor. In the event that the fixed platform 14 cannot be approached by the jack-up rig 12 from a direction that allows the skidbase 16 to be loaded transverse the capping beams 28, then a series of beams (not shown) are secured transversely across the capping beams 28 to provide the adequate support for the skidbase 16.

Figure 14:
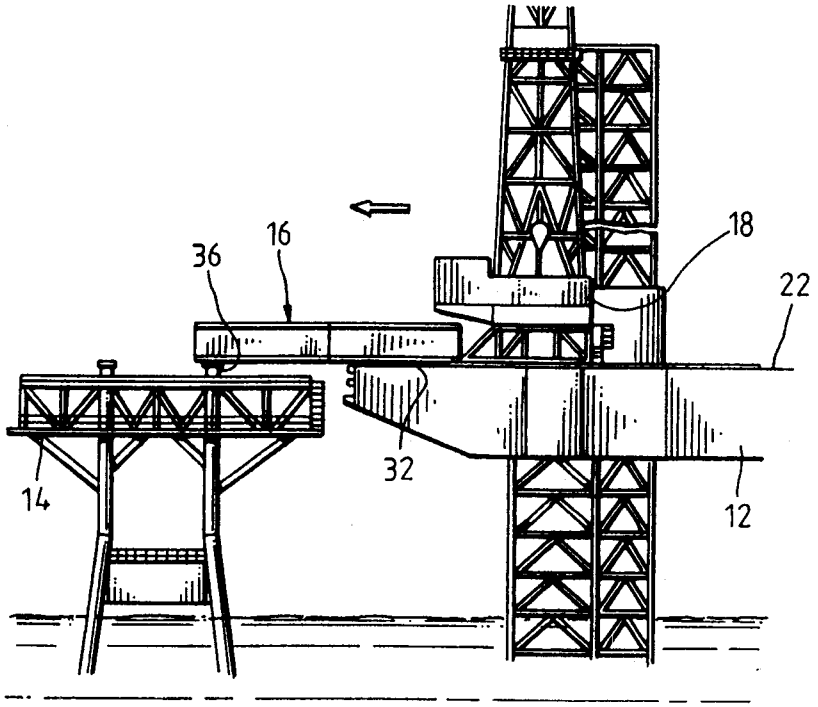
FIG. 14 illustrates the drilling package and the skidbase being skidded toward the fixed platform so that the skidbase is transferred from the jack-up rig deck to the fixed platform.

FIG. 14 illustrates the skidbase 16 and drilling structure 18 being skidded toward the fixed platform 14 so that the skidbase 16 is transferred from the deck of the jack-up rig 12 to the fixed platform 14. It should be appreciated that at this time, only the skidbase 16 is actually being transferred to the fixed platform 14. The drilling structure 18 is transferred to the fixed platform 14 in a subsequent step described more fully in conjunction with the description of FIGS. 5 and 6.

Preferably, the skidbase 16 is attached to the drilling structure 18 via a pinned connection (see FIG. 22) so that the weight of the drilling structure 18 prevents the skidbase 16 from tilting when it is in an intermediate, cantilevered position, extending from the deck 22 of the jack-up rig 12 toward the first capping rail 36 but unsupported by the capping rail 36. Once the skidbase 16 has bridged the gap between the first capping rail 36 and the deck 22 of the jack-up rig 12, then the skidbase 16 is no longer cantilevered from the deck 22 and does not rely on the weight of the drilling structure 18 for support. The skidbase 16 is capable of fully supporting itself once the skidding process is substantially complete and the skidbase 16 spans the capping rails 28, as shown, for example, in FIG. 15A.

It should be noted that the skidbase 16 is comprised of a support section 38 that extends between the capping rails 28 and a bridge section 40 that extends between the support section 38 and the jack-up rig 12. The bridge section 40, as is described more fully below, provides a structure on which the drilling structure 18 is moved across the gap between the jack-up rig and fixed platforms 12, 14 respectively to its operating position located on the support section 38.

Figure 15A:
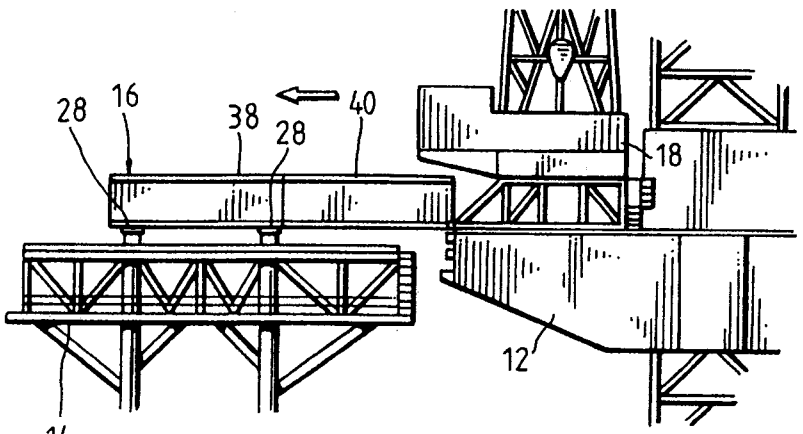
FIG. 15A illustrates the skidbase in its final position on the fixed, production platform with a bridge section of the skidbase substantially aligned with a transom of the jack-up rig.
Figure 15B:
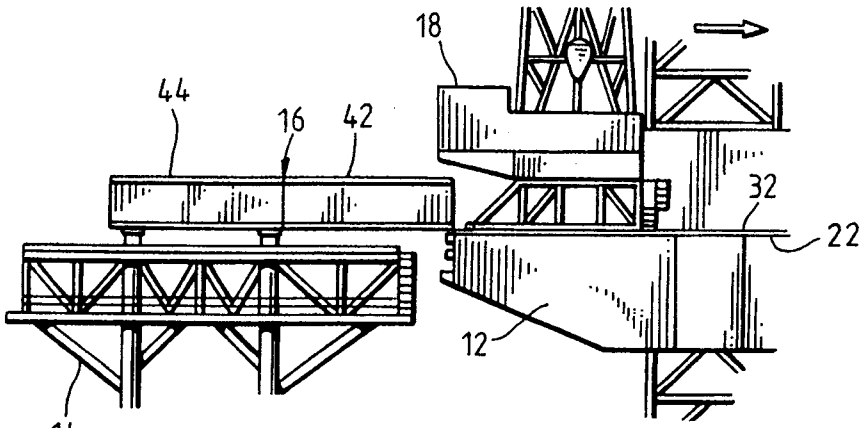
FIG. 15B illustrates the drilling structure separated from the skidbase and being moved in a direction away from the skidbase to allow the jack-up rig to be raised to a level aligned with a top surface of the skidbase.

FIG. 15B illustrates the drilling structure 18 separated (e.g., by unpinning) from the skidbase 16 and being moved in a direction away from the skidbase 16 to allow the jack-up rig 12 to be raised to a level aligned with a top surface 42 of the skidbase 16. The top surface 42 of the skidbase 16 preferably includes a pair of rails 44 substantially identical to the rails 32 on the deck 22 of the jack-up rig 12. Thus, when the deck 22 of the jack-up rig 12 is raised to its proper vertical height to allow transfer of the drilling structure 18 to the skidbase 16, the rails 44 on the skidbase 16 are linearly identically aligned with the rails 32 on the deck 22 of the jack-up rig 12.

Figure 16:
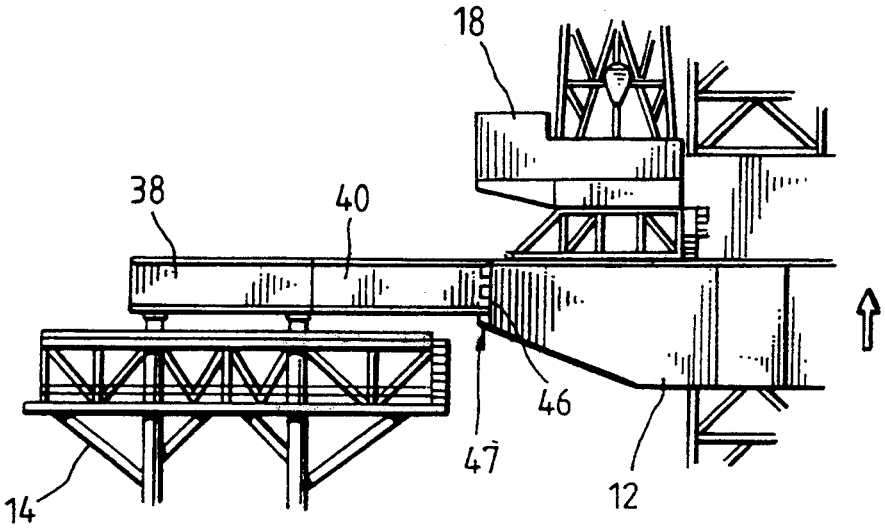
FIG. 16 illustrates the jack-up rig raised to the appropriate height for transferring the drilling structure onto the skidbase, with the transom of the jack-up rig being connected to the bridge section of the skidbase.
Figure 17:
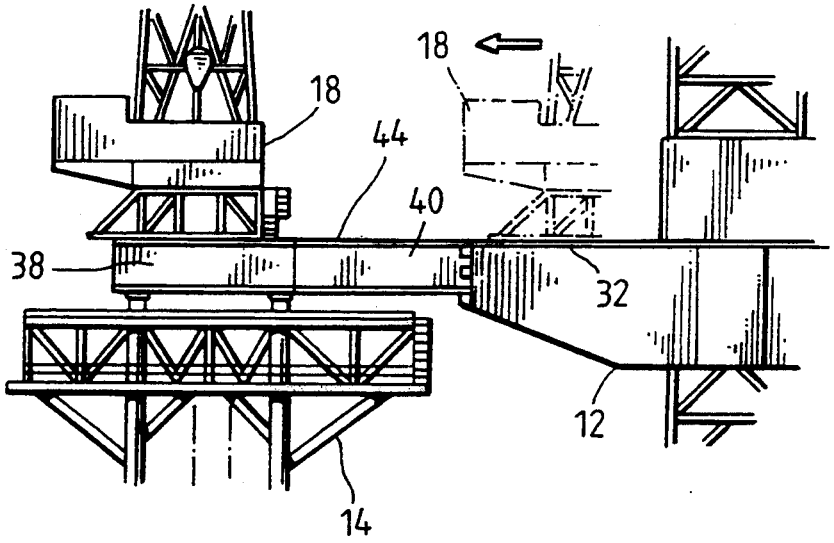
FIG. 17 illustrates the drilling structure being transferred across the bridge section and onto the skidbase.

Referring now to FIG. 16, the jack-up rig 12 is shown with the deck 22 raised to a vertical height in line with the skidbase 16. A transom 46 of the jack-up platform 12 is shown interlocked with the bridge section 40 of the skidbase 16 via a connection means 47. The connection means 47 between the bridge section 40 and the transom 46 is configured to automatically align and accurately connect the bridge section 40 to the transom 46 without the need for pins or other external devices to accomplish accurate alignment. A better appreciation of the operation and construction of the connection means 47 may be had by reference to FIGS. 24–30, discussed below.

Figure 19:
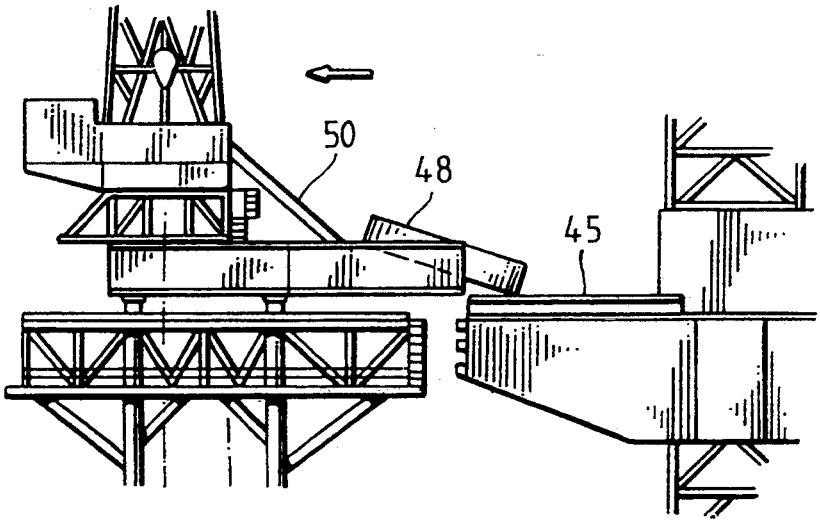
FIG. 19 illustrates the final rigging of the drilling structure, including a deck assembled over a slot in the jack-up rig, and a pipe rack extending between the jack-up rig deck and the fixed, rig platform.

With the rails 32, 44 substantially linearly aligned, the drilling structure 18 is skidded from the jack-up rig 12, across the bridge section 40, and onto the support structure 38 so that additional drilling or work-over operations may be performed from the fixed platform 14, as shown in FIG. 19.

Figure 18:
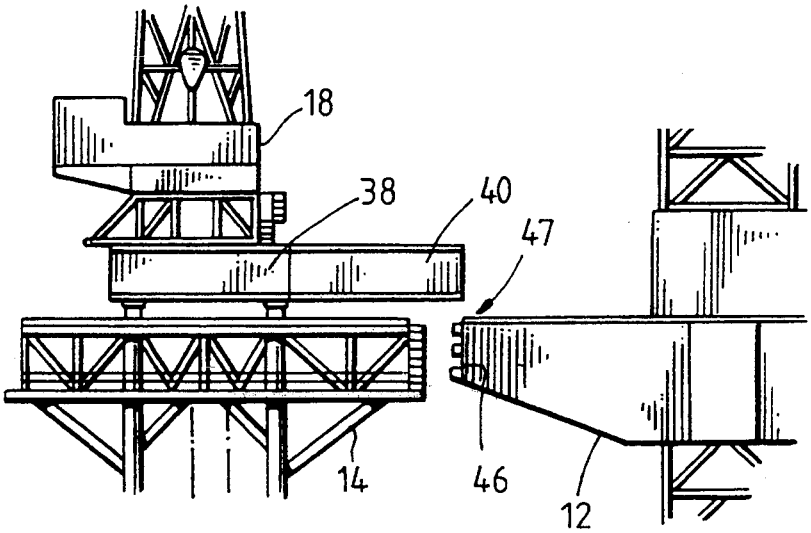
FIG. 18 illustrates the jack-up rig separated from the bridge section and lowered.

Once transfer of the drilling structure 18 is complete, the deck 22 of the jack-up rig 12 may be lowered to the position illustrated in FIGS. 18–19. A temporary deck 45 (FIG. 19) is preferably assembled over the slot 202 in the jack-up rig in a manner known to persons skill in the art. From this relative position of the deck 22 of the jack-up rig 12 and the fixed platform 14, the transfer of additional drilling materials from the jack-up rig 12 to the fixed platform 14 is facilitated.

Preferably, the connection means 47 automatically releases the interconnection between the jack-up rig 12 and the bridge section 40 so that the deck 22 of the jack-up rig 12 is free to be lowered to any desired position to facilitate material transfer.

FIG. 19 shows a pipe rack 48 which extends between the temporary deck 45 of the jack-up rig 12 and the drilling structure 18 now positioned on the fixed platform 14. The pipe rack 48 is situated at an angle, which is a function of the height differential between the deck 22 of the jack-up rig 12 and the skidbase 16. The inclination of the pipe rack 48 encourages the transfer of drilling pipe 50 from a substantially horizontal position on or near the temporary deck 45 of the jack-up rig 12 to a vertical position in which it is used on the fixed platform 14. The drilling pipe 50, of course, is threaded together to form a hollow core cylinder to which a drill bit or work-over tool (not shown) is attached and passed vertically into a well-bore (not shown) at the sea floor 26.

At this time, the transfer of the entire drilling apparatus 10 is substantially complete. However, for a proper appreciation of the advantages and operation of the instant invention, reference should be had to the preferred configuration of the skidbase 16, and, in particular, to the automatic connection means 47 between the bridge section 40 and the transom 46 of the jack-up rig 12.

Figure 20:
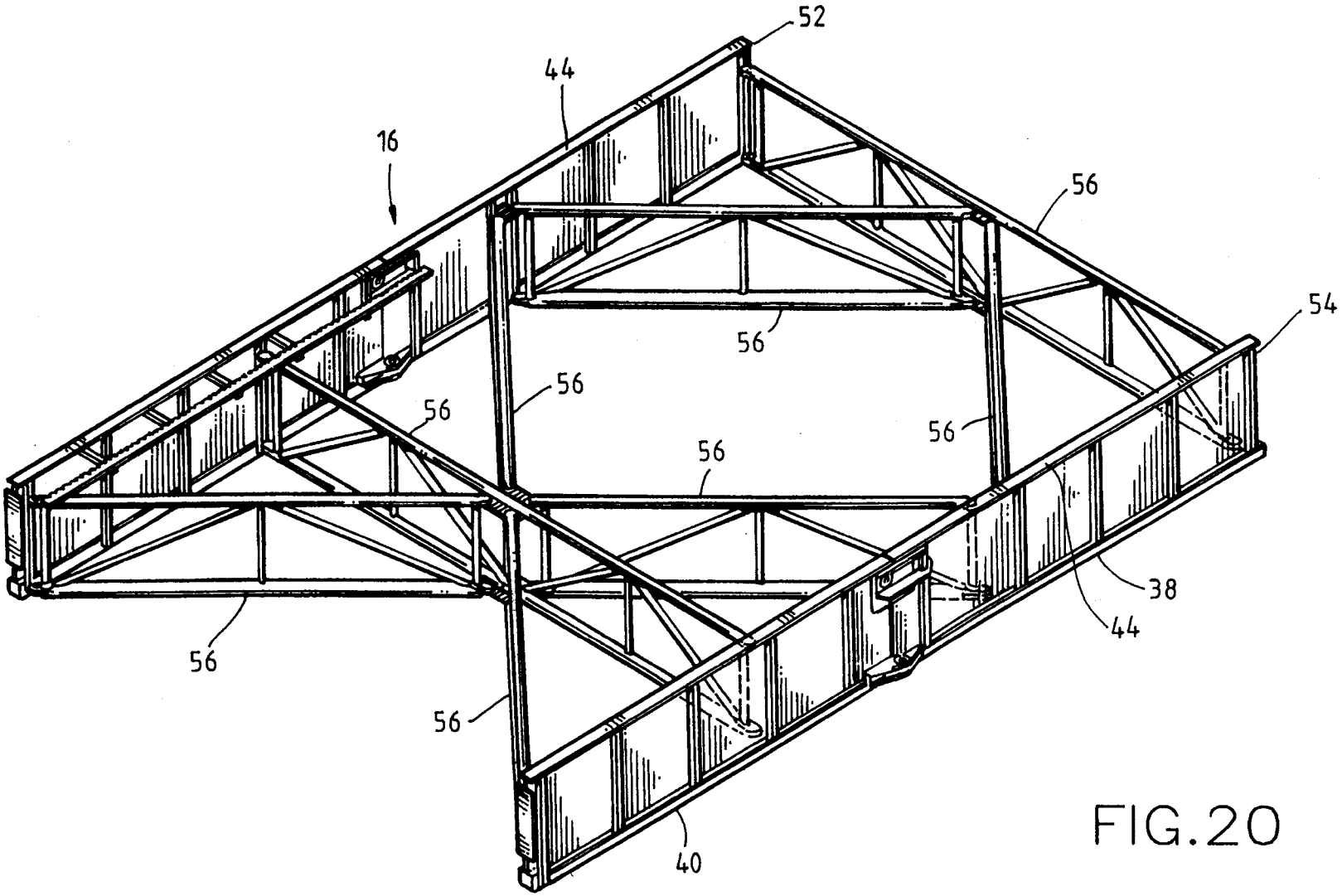
FIG. 20 illustrates a perspective view of the skidbase.
Figure 21:
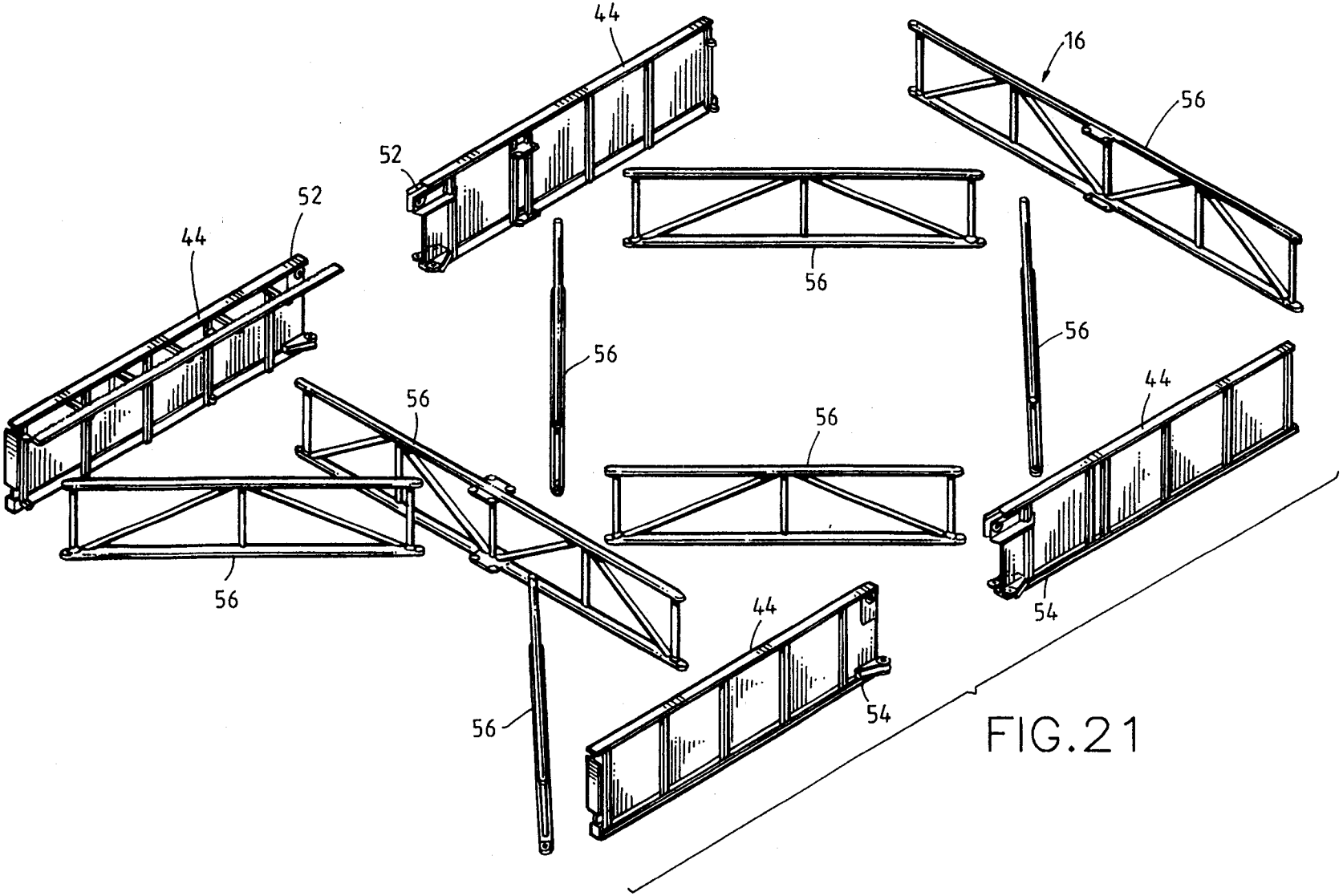
FIG. 21 illustrates an exploded perspective view of the skidbase.

Thus, turning now to FIGS. 20 and 21, the skidbase 16 is illustrated in greater detail and is shown in assembled and exploded, perspective views respectively. The skidbase 16 includes a pair of parallel, spaced-apart beams 52, 54. The beams 52, 54 are interconnected by a plurality of open trusses 56 extending therebetween, as is more apparent from the exploded view of the skidbase 16 shown in FIG. 21. The open trusses 56 are designed to support the beams 52, 54 in their substantially upright position, and when connected together, cause the skidbase 16 to act as a substantially integral unit. Preferably, the open trusses 56 and beams 52, 54 are assembled together by a plurality of pin and eye arrangements similar to those described below in conjunction with FIGS. 22 and 23.

The skid rails 44 are formed on an upper surface of each of the beams 52, 54. It should be remembered that the skid rails 44 are used to transport the drilling structure 18 from the deck 22 into its desired position on the support section 38 of the skidbase 16.

Figure 22:
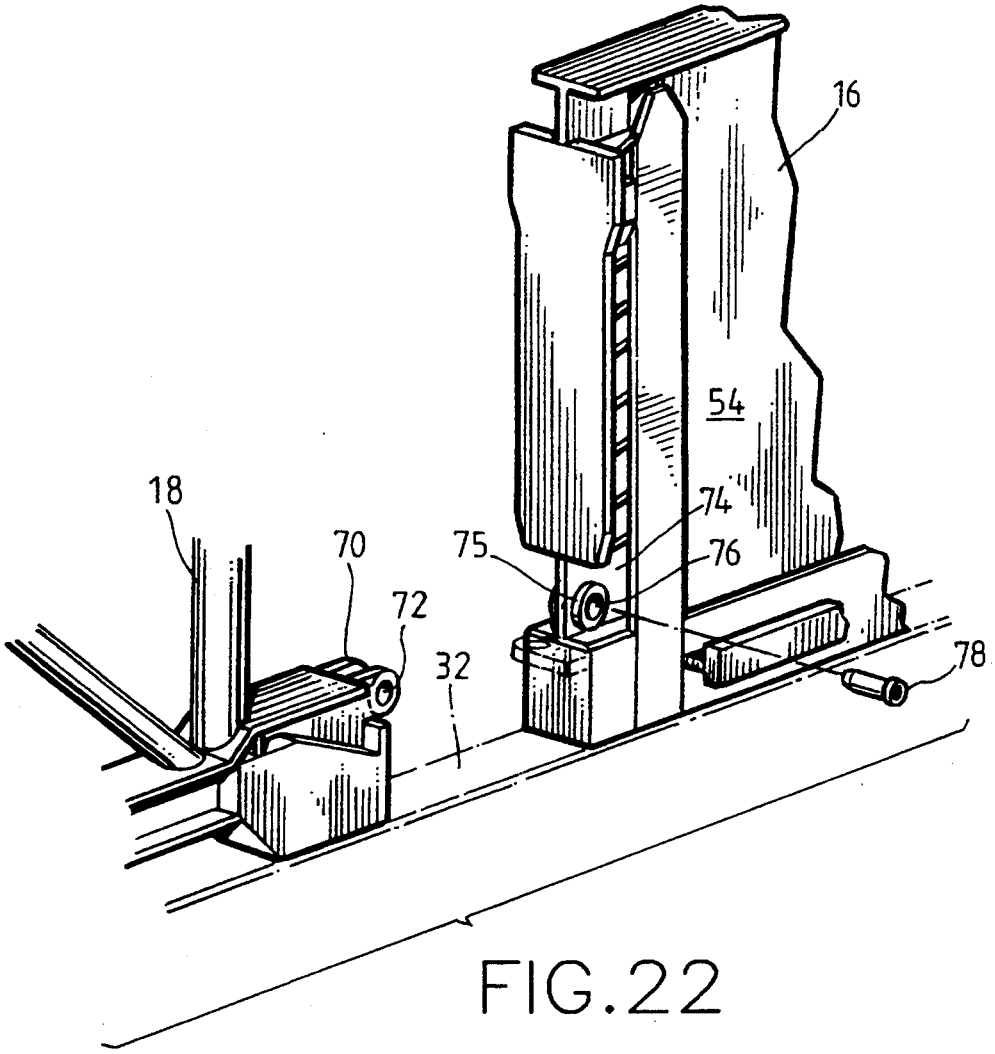
FIG. 22 illustrates a perspective view of part of the connection between the drilling structure and the skidbase.

The connection between the drilling structure 18 and the skidbase 16 is illustrated in FIG. 22. While only the connection to the beam 54 is illustrated, those skilled in the art readily recognize that the connection to the beam 52 is substantially similar. The drilling structure 18 and skidbase 16 are shown resting on the skid rail 32 on the deck 22 of the jack-up rig 12. Since this connection is not permanent and, in fact, is used only during the transfer of the skidbase 16 from the jack-up rig 12 to the fixed platform 14, the connection between the skidbase 16 and the drilling structure 18 is necessarily temporary.

For example, the drilling structure 18 includes a vertically arranged bifurcated flange 70 with a bore 72 extending perpendicularly therethrough. A tab section 74 on the beam 54 of the skidbase 16 has a perforated boss 75 with a width substantially similar to the spacing in the bifurcated flange 70. Thus, the bifurcated flange 70 extends about and encompasses the perforated boss 75 on the tab section 74 of the beam 54. A perforation or eye 76 extends through the tab section 74 and is generally aligned with eyes 72 in the bifurcated flange 70. A pin 78 is insertable through the eyes 72, 76 and can thereby temporarily interlock the beam 54 with the drilling structure 18. It should be appreciated that the pin 78 is readily removable between the stages illustrated in FIGS. 15A and 15B to allow the drilling structure 18 to be skidded a short distance away from the skidbase 16. This short skidding process provides clearance for the deck 22 of the jack-up rig 12 to be raised level with the top of the skidbase 16.

Figure 23:
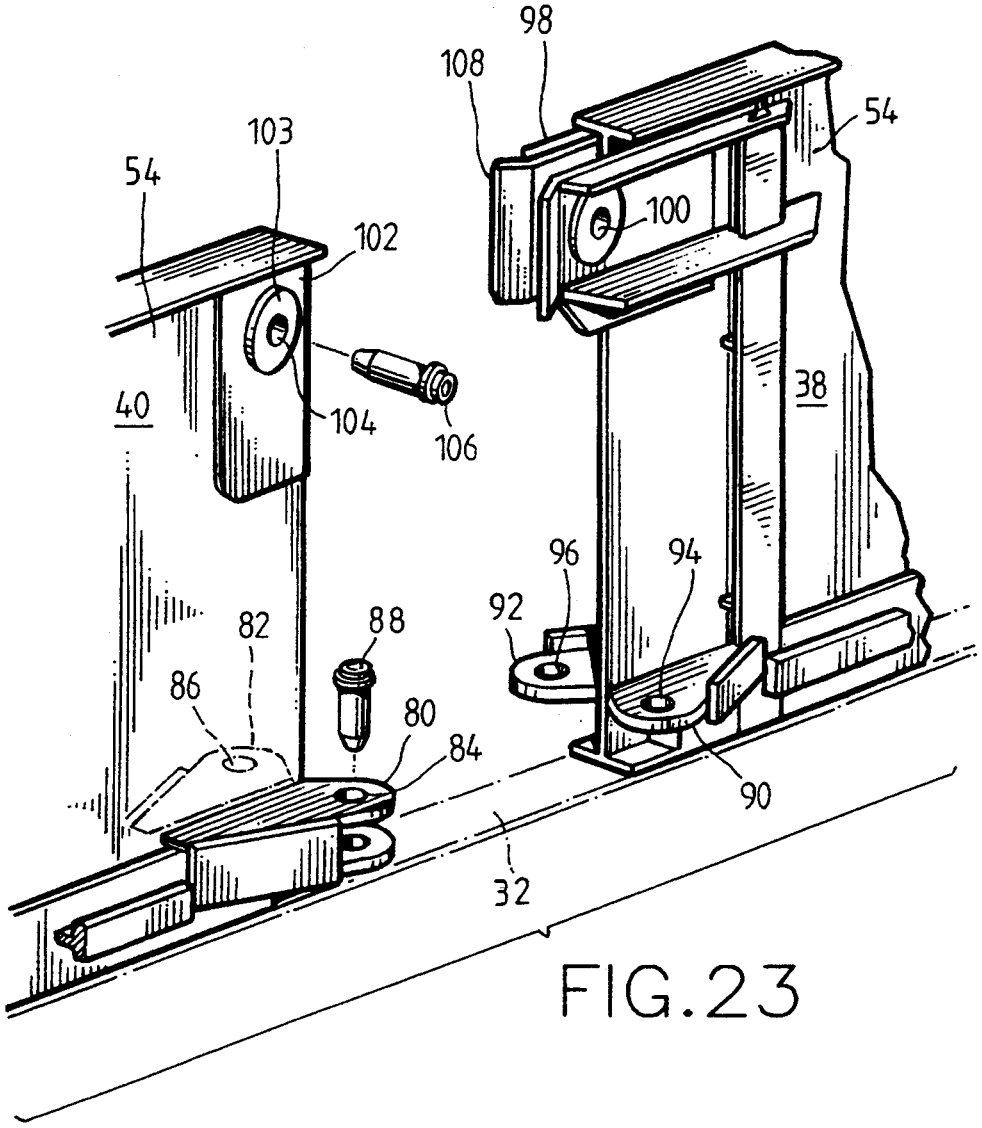
FIG. 23 illustrates a perspective view of the connection between the bridge and the skidbase.

As is apparent from FIGS. 20 and 21, the beams 52, 54 are of a two piece construction, defining the support structure 38 and the bridge section 40 of the skidbase 16. Connection of the bridge and support sections 40, 38 of the beam 54 is illustrated in FIG. 23. It should be appreciated that the connection between the bridge and support sections 40, 38 receives a very high loading force during the transfer of the drilling section 18 thereacross. In some cases the capping rails 28 may fully support the support section 38, and the bridge section 40 will be supported only at its connections with the support section 38 and the transom 46 of the jack-up rig 12.

The bridge section 40 includes a pair of bifurcated flanges 80, 82 extending horizontally from opposite sides of a beam 54 of the bridge section 40. Each of the pair of bifurcated flanges 80, 82 includes a vertical eye 84, 86 extending therethrough and adapted for receiving a connection pin 88 therein. The support section 38 includes a pair of single perforated flanges 90, 92 extending horizontally therefrom and spaced above the skid rail 32 a distance sufficient to allow the single flanges 90, 92 to slide into the spaces in the bifurcated flanges 80, 82. The single flanges 90, 92 have corresponding eyes 94, 96 extending vertically therethrough and aligning with the boreholes 84, 86 so that the pin 88 is insertable therethrough to capture the bridge and support sections 40, 38 against relative movement therebetween.

This first pinned location is located adjacent a lower surface of the bridge and support sections 40, 38. Thus to further enhance the stability of the skidbase 16 and to prevent pivotal movement between the bridge and support sections 40, 38, a second pinned connection is located adjacent an upper edge of the beam 54. The support section 38 includes a vertically arranged bifurcated flange 98 with a horizontal eye 100 extending therethrough. The bridge section 40 includes a tab section 102 having a perforated boss 103 with a width substantially similar to the spacing in the bifurcated flange 98. The eye 104 extends through the tab section 102 and is substantially alignable with the eye 100 so that a pin 106 can be inserted therethrough and capture the bridge and support sections 40, 38 against relative movement therebetween.

To assist in aligning the bridge and support sections 40, 38 of the beams 52, 54, the bifurcated flange 98 includes a tapered section 108 at its distal end so that the spacing in the bifurcated flanges 98 is increased at its distal end. This increased width ensures that a slightly misaligned tab section 104 will be guided into the bifurcated flange 98 as the bridge and support sections 40, 38 are moved toward one another. Similarly, the bifurcated and single flanges 80, 82, 90, 92 are also tapered inward to enhance alignment of the bridge and support sections 40, 38.

Referring now to FIGS. 24–29, the automatic connection means 47 between the transom 46 of the jack-up platform 12 and the bridge section 40 of the skidbase 16 is described in greater detail.

Figure 24:
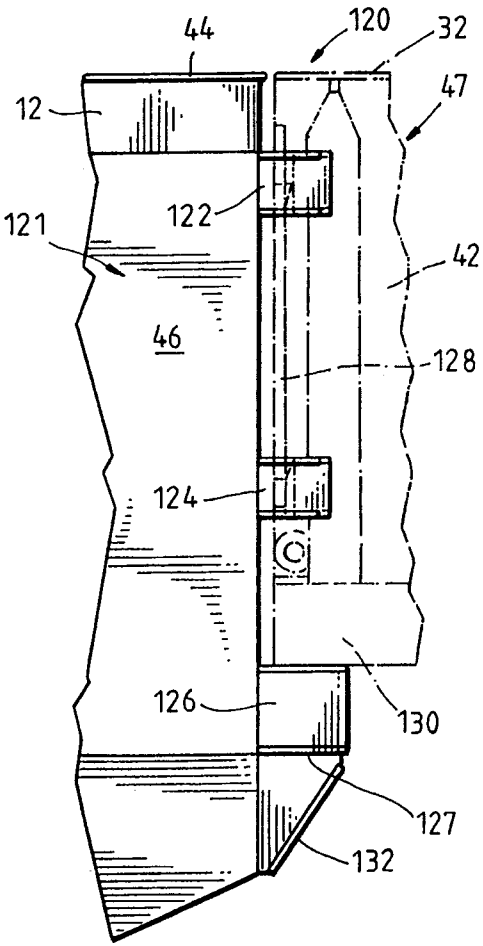
FIG. 24 illustrates a side view of the connection between the jack-up rig hull and the bridge, including a lock formed from a blade member and a guide assembly.

FIG. 24 illustrates a side view of part of the transom 46 of the jack-up rig 12. The bridge section 40 is shown in phantom lines, interacting with the transom 46 to form the connection means 47. The connection means 47 includes a lock mechanism 120, which is comprised of three major components: a guide assembly 121, a stop 126, and a blade member 128. The guide assembly 121 takes the form of an upper and lower guide 122, 124, which, along with and the stop 126, are fixedly connected to the transom 46. The blade member 128 is fixedly connected to the bridge section 40 and, in the locked position, is captured within the guides 122, 124. The bridge section 40 rests on and is supported by the stop 126.

As discussed in conjunction with FIGS. 15B and 16, the connection means 47 operates during movement of the transom 46 in a generally upward vertical direction while the bridge section 40 remains substantially stationary. Therefore, it should be appreciated that the blade member 128 remains substantially stationary as the transom 46 and guide members 122, 124 are raised into contact with the blade member 128. The blade member 128 passes through the upper and lower guide members 122, 124 as the transom 46 moves upward until a lower section 130 of the bridge section 40 contacts the stop 126. The guide members 122, 124 do not directly support the weight of the bridge 40, but rather, guide the blade member 128 and, accordingly, the bridge 40 into proper orientation so that the skid rails 44, 32 are vertically aligned and spaced a preselected horizontal distance apart.

The stop 126, on the other hand, supports the weight of the bridge 40 and the drilling structure 18 as it passes thereacross. Accordingly, the stop 126 is securely fastened to the transom 46 by any suitable means, such as, welding, threaded nut connection, or integral construction therewith. Further, a support bracket 132 preferably extends between the transom 46 and a lower surface 127 of the stop 126 to enhance its load carrying capabilities.

The guide members 122, 124 and the blade member 128 are designed to guide the bridge section 40 into its proper orientation in two stages. The bridge section 42 is first roughly aligned by interaction between the blade 128 and the upper guide member 122. Thereafter, as the transom 46 continues to rise vertically, the lower guide member 124 engages the blade member 128 and provides a second, finer stage of alignment. This finer, second stage of alignment is enhanced by further interaction between the blade member 128 and the upper guide member 122.

Figure 25:
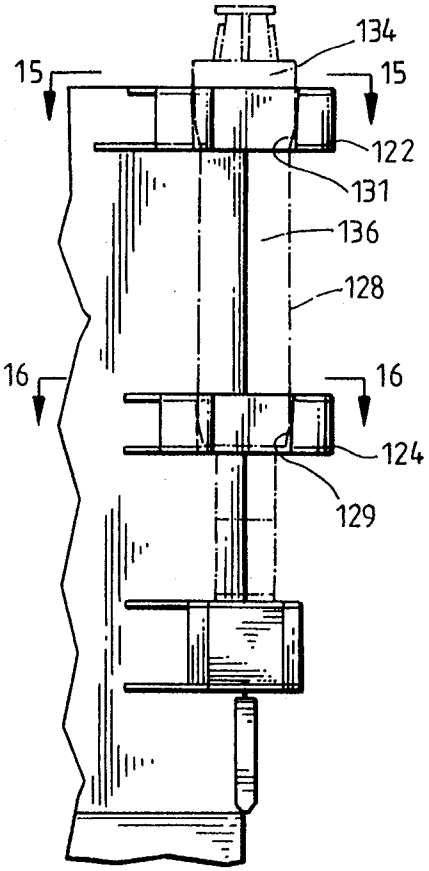
FIG. 25 illustrates an end view of the lock, with the blade member shown in phantom within the guide assembly.

As can be seen more clearly in FIG. 25, the blade member 128 has an upper section 134 and a lower section 136 of substantially different width. The widths of the upper and lower sections 134, 136 correspond to the different widths of the upper and lower guide members 122, 124. Thus, as lower section 136 of the blade member 128 enters the upper guide member 122, it has a substantially narrower width than the width of the upper guide member 122. Thus, any severe misalignment of the blade member 128 relative to the upper guide member 122 is corrected by engagement therebetween.

However, since the blade member 128 is substantially narrower than the upper guide member 122, complete alignment between the bridge section 40 and the transom 46 is not yet accomplished. Rather, as the transom 46 continues to rise, the lower guide member 124 engages the lower section 136 of the blade member 128 to further align the bridge section 40 relative to the transom 46.

Further, the distance between the lowest portions of the upper and lower section 134, 136 generally corresponds to the distance between the upper and lower guide members 122, 124. Thus, as the lower section 136 of the blade member 128 engages the lower member 124, the upper section 134 of the blade member 128 similarly engages the upper guide member 122.

To ensure gradual, even correction to the position of the bridge 40, the blade member 128 is preferably tapered in an initial section or distal end 129 adjacent its lower section 136 and at the interface or intermediate section 131 between the upper and lower sections 134, 136. Likewise, the width of the guide members 122, 124 are also preferably tapered top to bottom.

Figure 26:
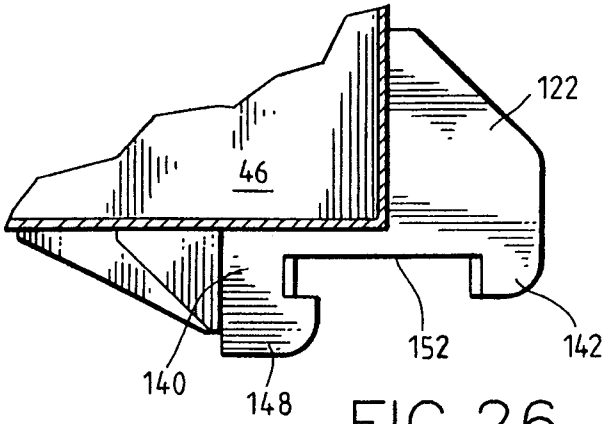
FIG. 26 illustrates a top view of an upper guide member of the guide assembly.
Figure 27:
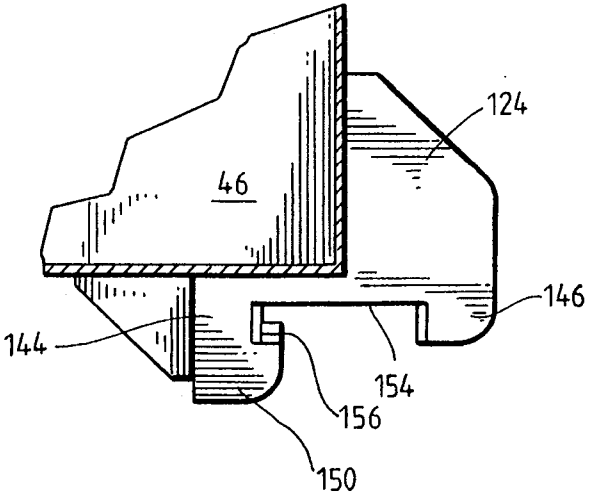
FIG. 27 illustrates a top view of a lower guide member of the guide assembly.

Top views of the upper and lower guide members 122, 124 are shown in FIGS. 26 and 27 respectively. The upper and lower guide members 122, 124 are substantially similar in construction. Each of the guide members 122, 124 includes a pair of spaced apart, lateral movement limiting shoulders 140, 142; 144, 146, which define a width that corresponds respectively to the upper and lower section 134, 136 of the blade member 128. Further, each of the guide members 122, 124 also includes a longitudinal movement limiting arm 148, 150 spaced from a base surface 152, 154. The arms 148, 150 capture the blade member 128 against horizontal movement away from the transom 46. Further, the arms 148, 150 have associated therewith, cam surfaces (see FIGS. 28–30), which urge the blade member 128 and the skidbase 16 toward the transom 46 for a precise alignment. A cam surface 156 associated with the lower guide member 124 can be seen attached to the arm 150 and extending into the space between the base 154 and the arm 150.

A better appreciation of the operation of the cam surfaces may be had by reference to FIGS. 28–30. FIG. 28 illustrates a perspective view of one side of the transom 46 positioned vertically below the skidbase 16 and generally aligned therewith so that upward movement of the transom 46, as indicated by the arrow 160, causes the guide members 122, 124 to engage the blade member 128. The cam surface 156 associated with the lower guide member 124 is illustrated in phantom lines. A second cam surface 162 associated with the upper guide assembly 122 is shown attached to a rear surface 163 of the blade member 128.

The cam surfaces 162, 156 are illustrated in greater detail in FIGS. 29 and 30, respectively. The cam surfaces 156, 162 have at least one tapered surface thereon so that when the blade member 128 is engaged by the guide members 122, 124, the cam surfaces 156, 162 progressively urge the blade member 128 (and hence the skidbase 16) into precise alignment with the transom 46. One advantage in attaching the cam surface 156 to the lower guide member 124 while attaching the cam surface 162 to the blade member 128 is to allow the lower section 136 of the blade member 128 to freely pass through the upper guide member 122 without contact between a cam surface and the blade member 128. Rather, the cam action for precise alignment occurs when the transom 46 is near its extreme upward vertical position. In this manner, horizontal movement of the skidbase 16 occurs at the end of the vertical positioning step. It should be appreciated that if the cam surface 162 was attached to the arm 148, then the lower section 136 of the blade member 128 would engage the cam surface 162 during its movement through the upper guide assembly 122.

While the blade member 128 and guide assembly 121 have been described in the singular form, it should be appreciated that operation of the lock 120 may be improved by the use of two spaced-apart assemblies. Preferably, a pair of blade members 128 are mounted on the beams 52, 54 and interact with two sets of guide assemblies 121 and stops 126 located on the transom 46 of the jack-up platform 12.

With the arrangement of the above-described components, a stagewise alignment can be achieved between the skidbase 16 and the jack-up platform 12. As the jack-up platform 12 is raised, the upper guide member 122 first encounters the lower section 136 of the blade member 128. The tapered initial section 129 of the blade member 128 is guided into a relatively rough alignment with the tapered lateral movement limiting shoulders 140, 142 of the upper guide member 122. This relatively rough alignment situates the blade member 128 to encounter the lower guide member 124. When the lower guide member 124 engages the lower section 136 of the blade member 128, a finer alignment is achieved as the tapered lateral movement limiting shoulders 144, 146 cam the lower section 136 of the blade member 128 into position. At the same time that the lower guide member 124 is camming the lower section 136 of the blade member 128, the upper section 134 of the blade member 128 is engaging the upper guide member lateral movement limiting shoulders 140, 142 to enhance the camming action on the blade member 128 and provide a progressive, fine alignment of the blade member 128. Finally, a still yet finer alignment of the skidbase 16 and the jack-up platform 12 is achieved by the action of the upper and lower cam surfaces 162, 156.

The upper cam surface 162 urges the blade member 128 toward the base 152 of the upper guide member 122, and the lower cam surface 156 urges the blade member 128 toward the base 154 of the lower guide member 124. The upper and lower lateral movement limiting shoulders 140-144 with their tapered surfaces, and the upper and lower cam surfaces 162, 156 with their tapered surfaces coact with the stop member 126 to precisely and finely align the skidbase 16 with the jack-up rig 12 to position their respective skid rails 44, 32 adjacent each other for an advantageous transfer of the drilling structure 18 from the jack-up rig 12 to the fixed platform 14 and the back again. A surprisingly high degree of precision is achievable without the use of pins or mechanical devices in the practice of this invention.

I claim:

1. A construction crane package suitable for skidding on and off a jack-up rig, the base of the construction crane being wider than a skid fairway defined by the skid rail width on the jack-up rig, the improvement comprising:

a pony comprising a plurality of beams of sufficient length and strength to support the construction crane, said beams being substantially parallel to each other and spaced apart a width that facilitates introducing said pony into the skid fairway on said jack-up rig;

a plurality of support structures within said pony that raise the base of the construction crane to an elevated zone above said skid fairway, the elevated zone having a width at least as great as the width of the base of the construction crane, said elevated zone facilitating skidding said construction crane on and off said jack-up rig and over obstacles outside the skid fairway, said support structures being suitable to support an overhang of the construction crane base caused by the construction crane base being wider than the width of the skid fairway, said support structures having rigidity sufficient to facilitate operation of the construction crane from the elevated zone when the jack-up rig is jacked-up, said plurality of support structures being of sufficient light weight to facilitate movement during the raising and lowering of said jack-up rig.

2. The construction crane package of claim 1, wherein said pony has a bottom surface and a top surface interconnected by support structures such that the top surface is wider than the bottom surface.

3. The construction crane package of claim 1, wherein some of said support structures are oriented at an angle from a vertical axis.

4. The construction crane package of claim 1, further comprising a plurality of support plates for raising the base of the construction crane.

5. The construction crane package of claim 4, wherein some of said support structures are joined to some of said support plates at unequal angles.

6. The construction crane package of claim 4, wherein at least half of said support plates are joined to said support structures at different angles.

7. A method of providing a construction crane to a construction site comprising the steps of:

providing a jack-up rig having a hull and a plurality of legs adapted for movement relative to the hull, with the hull having a deck;

skidding a construction crane package onto the deck of the huh into a skid fairway, said skid fairway being narrower than a base of said construction crane, said construction crane package comprising said construction crane and a structure that raises said base of said construction crane to an elevated zone above said deck having a width greater than said skid fairway;

floating the jack-up rig to a first location for the use of the crane;

lowering the legs of the jack-up rig to secure the deck; and operating the construction crane at said first location from said elevated zone.

8. The method of providing a construction crane to a construction site of claim 7, wherein said steps are performed on a construction crane having a lifting capacity of not less than 450 tons.

9. The method of providing a construction crane to a construction site of claim 7, further comprising the steps of:

raising the legs of the jack-up rig to float the hull; and floating the jack-up rig to a second location.

10. The method of providing a construction crane to a construction site of claim 9 wherein said second location is a dock fixed to land.

11. The method of providing a construction crane to a construction site of claim 10, further comprising skidding the construction crane package off of the deck for the jack-up rig and onto the dock fixed to land.

12. The method of providing a construction crane to a construction site of claim 9, wherein said second location is an offshore platform fixed to a sea bed.

13. The method of providing a construction crane to a construction site of claim 12, further comprising skidding the construction crane package off of the deck of the jack-up rig and onto the offshore platform fixed to a sea bed.

14. The method of providing,a construction crane to a construction site of claim 9, wherein said raising steps are performed at substantially the same rate that said jack-up rig raises without the additional weight of the construction crane package.

15. A method of providing construction, demolition and drilling from a jack-up rig, comprising the steps of:

providing a jack-up rig having a huh and a plurality of legs adapted for movement relative to the hull, with the hull having a deck;

skidding a construction crane package onto the deck of the jack-up rig and into a skid fairway having a width narrower than a base of said construction crane, said construction crane package comprising said construction crane and a structure that raises said base of said construction crane to an elevated zone above said deck;

floating the jack-up rig to a first location for the use of the crane;

lowering the legs of the jack-up rig to secure the deck;

operating the construction crane from said elevated zone at said first location to perform construction or demolition;

raising the legs of the jack-up rig to float the hull:

floating the jack-up rig to a second location suitable for storage of the construction crane package;

skidding the construction crane package off of the jack-up rig at the second location;

skidding a drilling package onto the deck of the jack-up rig;

floating the jack-up rig to a third location for the use of the drilling package;

lowering the legs of the jack-up rig to secure the deck; operating the drilling package at said third location to perform drilling; and raising the legs of the jack-up rig to float the hull.

16. The method of providing construction, demolition and drilling from a jack-up rig of claim 15, further comprising the steps of:

floating the jack-up rig to a fourth location suitable for storage of the drilling package; and skidding the drilling package off of the jack-up rig at said fourth location.

17. The method of providing construction, demolition and drilling from a jack-up rig of claim 15, wherein said first and third locations are the same location.

18. The method of providing construction, demolition and drilling from a jack-up rig of claim 15, wherein the construction crane package has a lifting capacity of not less than 450 tons.

19. The method of providing construction, demolition and drilling from a jack-up rig of claim 16, wherein said second and fourth locations are land based.

20. The method of providing construction, demolition and drilling from a jack-up rig of claim 16, wherein said second and fourth locations are offshore platforms.

21. A construction crane package suitable for skidding on or off a jack-up rig, the base of the construction crane being wider than a skid fairway defined by the skid rail width on the jack-up rig, the improvement comprising:

a pony comprising a plurality of beams to support the construction crane, said beams configured to facilitate introducing said pony into the skid fairway on said jack-up rig;

means for raising the base of the construction crane to an elevated zone above said skid fairway, said elevated zone facilitating skidding said construction crane on or off said jack-up rig and over obstacles outside the skid fairway, said raising means being suitable to support an overhang of the construction crane base caused by the construction crane base being wider than the width of the skid fairway, said raising means having rigidity sufficient to facilitate operation of the construction crane from the elevated zone when the jack-up rig is jacked-up, said raising means being of sufficient light weight to facilitate movement during the raising and lowering of said jack-up rig.

22. A pony for supporting a construction crane during operation, comprising:

rails spaced apart to facilitate skidding said pony into a skid fairway on a jack-up rig, the skid fairway having a predetermined width;

a support structure coupled to said rails, said support structure adapted to raise a crane having a base with predetermined width above said rails into an elevated zone, the width of the crane base being greater than the width of the skid fairway; and said pony having a width substantially the same as the skid fairway width and less than the width of the crane base.

23. The pony of claim 22, wherein said support structure comprises a plurality of structural members.

24. The pony of claim 22, further comprising a crane ring substructure coupled to said support structure for supporting a crane ring.

25. The pony of claim 24, wherein a width of the crane ring substructure is greater than the spaced apart relation of said rails and substantially the same as a width of the crane ring.

26. The pony of claim 25, wherein said crane ring substructure is polygonal.

27. The pony of claim 23, wherein said structural members are tubular metal products.

* * * * *

UNITED STATES PATENT AND TRADEMARK OFFICE

CERTIFICATE OF CORRECTION

PATENT NO. : 5,388,930

DATED : February 14, 1995

INVENTOR(S) : Daniel F. McNease

It is certified that error appears in the above-identified patent and that said Letters Patent is hereby corrected as shown below:

Column 6, line 6, after "ring" delete --substructure--.

Column 15, claim 7, line 52, replace "huh" with --hull--.

Column 16, claim 14, line 21, delete ",".

Column 16, claim 15, line 28, replace "huh" with --hull--.

Signed and Sealed this

Eighteenth Day of April, 1995

Bruce Lehman

*Attest:*

BRUCE LEHMAN

*Commissioner of Patents and Trademarks*

*Attesting Officer*